US009698491B2

(12) United States Patent
Lee

(10) Patent No.: US 9,698,491 B2
(45) Date of Patent: Jul. 4, 2017

(54) MULTI-PANEL ANTENNA SYSTEM

(71) Applicant: Ubiquiti Networks, Inc., San Jose, CA (US)

(72) Inventor: Jude Lee, Fremont, CA (US)

(73) Assignee: UBIQUITI NETWORKS, INC., San Jose, CA (US)

( * ) Notice: Subject to any disclaimer, the term of this patent is extended or adjusted under 35 U.S.C. 154(b) by 0 days.

(21) Appl. No.: 14/987,674

(22) Filed: Jan. 4, 2016

(65) Prior Publication Data

US 2016/0156107 A1 Jun. 2, 2016

Related U.S. Application Data

(63) Continuation of application No. 14/886,744, filed on Oct. 19, 2015.

(60) Provisional application No. 62/086,525, filed on Dec. 2, 2014, provisional application No. 62/191,232, filed on Jul. 10, 2015.

(51) Int. Cl.

| | |
|---|---|
| ***H01Q 19/12*** | (2006.01) |
| ***H01Q 15/16*** | (2006.01) |
| ***H01Q 1/12*** | (2006.01) |
| ***H01Q 15/14*** | (2006.01) |
| ***H01Q 1/24*** | (2006.01) |
| ***H01Q 1/08*** | (2006.01) |
| ***H01Q 3/08*** | (2006.01) |

(Continued)

(52) U.S. Cl.

CPC ..... *H01Q 15/162* (2013.01); *H01Q 1/088* (2013.01); *H01Q 1/125* (2013.01); *H01Q 1/1207* (2013.01); *H01Q 1/1264* (2013.01); *H01Q 1/24* (2013.01); *H01Q 3/08* (2013.01); *H01Q 15/141* (2013.01); *H01Q 15/165* (2013.01); *H01Q 23/00* (2013.01)

(58) Field of Classification Search

CPC ..... H01Q 1/247; H01Q 1/08; H01Q 15/16; H01Q 15/161; H01Q 15/162; H01Q 15/165; H01Q 15/168; H01Q 19/12; H01Q 19/19; H01Q 19/134

USPC ..... 343/840, 912, 915; 342/351, 352

See application file for complete search history.

(56) References Cited

U.S. PATENT DOCUMENTS 3,140,491 A * 7/1964 Ashbaugh ..... H01Q 19/022 343/782

3,599,218 A * 8/1971 Williamson ..... H01Q 15/163 343/840

(Continued)

FOREIGN PATENT DOCUMENTS

WO 2010141548 A2 12/2010

*Primary Examiner* — Jessica Han

*Assistant Examiner* — Awat Salih

(74) *Attorney, Agent, or Firm* — Shun Yao; Park, Vaughan, Fleming & Dowler LLP

(57) ABSTRACT

A multi-panel antenna system may be disassembled and packaged into a container with substantially smaller dimensions than the assembled antenna system. The antenna system may include two or more reflector panels, such that a respective reflector panel can include a curved surface that may form a portion of a parabolic reflector, and can include an inter-panel fastener operable to align a side surface of the respective reflector panel with a side surface of another reflector panel. The antenna system may also include a mounting assembly that may be used to fasten a convex side of the two or more reflector panels to a surface external to the antenna system, and a feed assembly that may be attached to the mounting assembly.

26 Claims, 28 Drawing Sheets

(51) Int. Cl.
*H01Q 23/00* (2006.01)
*H01Q 19/19* (2006.01)

(56) References Cited

U.S. PATENT DOCUMENTS 4,378,560 A * 3/1983 Khorsand ..... F24J 2/12 343/912
4,893,132 A * 1/1990 Habibi ..... H01Q 15/162 343/840
5,050,976 A * 9/1991 Flint ..... G02B 5/10 343/912
5,061,945 A * 10/1991 Hull ..... H01Q 15/20 343/840
5,969,692 A * 10/1999 Ishizuka ..... H01Q 1/125 343/765
6,340,956 B1 * 1/2002 Bowen ..... H01Q 15/161 343/840
6,445,360 B2 * 9/2002 Al-Rawi ..... 343/781 R
6,531,992 B1 * 3/2003 Ehrenberg ..... H01Q 1/1235 343/761
8,013,798 B2 * 9/2011 Blalock ..... H01Q 1/125 343/757
8,466,847 B2 * 6/2013 Pera ..... H01Q 19/19 343/833
8,665,134 B2 * 3/2014 McLaughlin ..... G01S 13/951 342/26 R
2007/0052612 A1 * 3/2007 Trajkovic ..... H01Q 3/08 343/840
2007/0069970 A1 * 3/2007 Argaman ..... H01Q 15/162 343/840
2008/0111758 A1 * 5/2008 Griffiths ..... H01Q 19/19 343/837
2008/0291118 A1 11/2008 Haight
2009/0109122 A1 * 4/2009 Gonzalez ..... H01Q 1/084 343/915
2009/0109123 A1 * 4/2009 Gonzalez ..... H01Q 1/084 343/915
2009/0243955 A1 * 10/2009 Legare ..... H01Q 1/08 343/882
2009/0262033 A1 * 10/2009 King ..... H01Q 1/088 343/713
2010/0238082 A1 * 9/2010 Kits van Heyningen ..... H01Q 3/08 343/761
2010/0315306 A1 * 12/2010 Strydesky ..... H01Q 15/16 343/840
2011/0291914 A1 12/2011 Lewry et al.
2012/0098727 A1 * 4/2012 Vion ..... H01Q 1/125 343/840
2013/0069832 A1 * 3/2013 Butler ..... H01Q 19/132 343/705
2013/0088409 A1 * 4/2013 Son ..... H01Q 1/288 343/912
2013/0141307 A1 * 6/2013 Nurnberger ..... H01Q 15/16 343/912
2013/0271337 A1 * 10/2013 Lee ..... H01Q 15/16 343/840
2013/0307721 A1 * 11/2013 Son ..... H01Q 3/08 342/352
2013/0341483 A1 * 12/2013 Son ..... H01Q 3/02 248/580
2013/0342390 A1 * 12/2013 Cha ..... H01P 1/161 342/352
2014/0125542 A1 * 5/2014 Honzawa ..... H01Q 13/0258 343/840
2014/0152492 A1 * 6/2014 Zimmerman ..... H01Q 15/162 342/352
2014/0225782 A1 8/2014 Sanford
2014/0366929 A1 * 12/2014 Blau ..... H02S 20/32 136/246
2015/0349417 A1 * 12/2015 Richards ..... H01Q 1/1257 342/352
2016/0013562 A1 * 1/2016 Yang ..... H01Q 1/1235 343/840
2016/0087345 A1 * 3/2016 LeBayon ..... H01Q 1/42 343/840

* cited by examiner

MULTI-PANEL ANTENNA SYSTEM

RELATED APPLICATION

This application is a continuation application of application Ser. No. 14/886,744, entitled "MULTI-PANEL ANTENNA SYSTEM," by inventor Jude Lee, filed 19 Oct. 2015, which claims the benefit of:

U.S. Provisional Application No. 62/086,525, entitled "Multiple Panel Parabolic Reflector Dish Antennas," by inventor Jude Lee, filed Dec. 2, 2014; and U.S. Provisional Application No. 62/191,232, entitled "MULTI-PANEL ANTENNA SYSTEM," by inventor Jude Lee, filed 10 Jul. 2015, the disclosures of which are incorporated herein in their entirety.

BACKGROUND

Field

This disclosure is generally related to a multi-panel directional antenna. More specifically, this disclosure is related to a directional antenna that can be transported in a compact package, and is easily assembled by an end-user.

Related Art

Directional antennas typically include a wide parabolic reflector, and can include a feed assembly that is orthogonal to the concave face of the parabolic reflector. If such a directional antenna were to be packaged in a box in assembled form, the box would require the dimensions of the full antenna, but would have mostly empty space. On the other hand, if the antenna feed assembly were to be packaged detached from the parabolic reflector, the box would still need to have two dimensions that match the height and width of the parabolic reflector.

Unfortunately, any unused space in the antenna packaging may result in consuming valuable storage space in a warehouse. To make matters worse, the large packaging dimensions can result in large shipping costs when the directional antenna is to be shipped to a reseller or to a customer.

SUMMARY

One embodiment provides a multi-panel antenna system that may be disassembled and packaged into a container with substantially smaller dimensions than the assembled antenna. The antenna system may include two or more reflector panels, such that a respective reflector panel can include a curved surface that may form a portion of a parabolic reflector, and can include an inter-panel fastener operable to align a side surface of the respective reflector panel with a side surface of another reflector panel. The antenna system may also include a mounting assembly that may be used to fasten a convex side of the two or more reflector panels to a surface external to the antenna system. Moreover, the antenna system can include a feed assembly that may be attached to the mounting assembly.

In some embodiments, the multi-panel antenna system can also include a multi-panel fastener operable to couple the two or more reflector panels to each other.

In some embodiments, the inter-panel fastener of the respective reflector panel may align the respective reflector panel to the other reflector panel along a first axis. Moreover, the multi-panel fastener may align the respective reflector panel to the other reflector panel along at least a second axis orthogonal to the first axis, which can prevent the two or more reflector panels from becoming uncoupled from each other.

In some embodiments, the feed assembly may be mounted on a concave side of the parabolic reflector.

In some embodiments, at least one of the two or more reflector panels may include a through-hole for attaching the feed assembly to the multi-panel fastener through the through-hole.

In some embodiments, attaching the feed assembly to the multi-panel fastener may have the effect of fastening the feed assembly and the multi-panel fastener to the two or more reflector panels.

In some embodiments, the feed assembly can include a release button for releasing the feed assembly from the multi-panel fastener.

In some embodiments, the inter-panel fastener comprises at least one of a post and slot coupling, a hook and slot coupling, a snap-fit coupling, a sleeve and bore coupling, a track and sliding carriage coupling, and a screw hole.

In some embodiments, the two or more panels can include at least three panels, such that a center reflector panel of the three panels may be coupled to a side reflector panel at each of two opposing side surfaces of the center reflector panel.

In some variations to these embodiments, the multi-panel fastener can include a coupler for coupling the mounting assembly to a convex side of the center panel.

In some embodiments, the feed assembly can include a radio inside the antenna feed, can include a data port for the radio on a proximal end of the feed assembly.

In some variations, the data port can provide a digital data interface for the radio.

In some embodiments, the mounting assembly can include a ball joint, which facilitates adjusting an altitude and/or azimuth of the parabolic reflector's direction In some embodiments, a respective reflector panel can include a plurality of openings arranged in a plurality of rows and columns.

In some variations to these embodiments, a respective opening may have an elongated shape.

In some embodiments, the two or more reflector panels, the multi-panel fastener, the feed assembly, and the mounting assembly can be packaged in a container as a kit.

In some embodiments, packaging the kit in the container involves placing the two or more reflector panels in the container on a bottom surface of the container, in a stacked configuration.

In a further variation, packaging the kit can involve placing a packaging insert on top of the stacked reflector panels, such that the packaging insert can include a molded insert that has been molded to have slots for the multi-panel fastener, the mounting assembly, and the antenna feed assembly.

In a further variation, packaging the kit can involve inserting the feed assembly, the multi-panel fastener, and the mounting assembly into the slots of the packaging insert.

BRIEF DESCRIPTION OF THE FIGURES

In the figures, like reference numerals refer to the same figure elements.

DETAILED DESCRIPTION

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present invention is not limited to the embodiments shown, but is to be accorded the widest scope consistent with the principles and features disclosed herein.

Overview

Embodiments of the present invention solve the problem of packaging a kit for a directional antenna in a compact container. The kit can include multiple near-equal size panels that can be assembled into a multi-panel parabolic reflector, and can include an antenna feed assembly and mounting assembly that may be easy to fasten against the parabolic reflector. For example, a directional antenna with a three-panel parabolic reflector may be packaged using a box with a width that may be approximately one-third the width of the parabolic reflector.

The compact size of the container makes can reduce the cost of storing or shipping the directional antenna, when compared to the cost of storing larger single-panel antenna systems. Moreover, the kit includes the components necessary for deploying the antenna to an installation site. For example, typical antenna systems have the reflector and antenna feeds shipped in separate packages. Also, the reflector is typically shipped as a single component, which can have a width and depth that consumes too much space (e.g., shelf space) in a warehouse or during shipping.

To make matters worse, because the reflector and feed are typically packaged in separate containers, a technician that is deploying the antenna system typically needs to remember to carry equal numbers of feeds and reflectors. If the technician forgets to take the feed or the reflector to the installation site, the technician would not be able to deploy the antenna system. In contrast, the kit for the multi-panel directional antenna of the present invention can be packaged in a single container to facilitate ensuring that the technician has the components necessary for deploying the directional antenna when the technician is at the installation site.

Figure 1A:
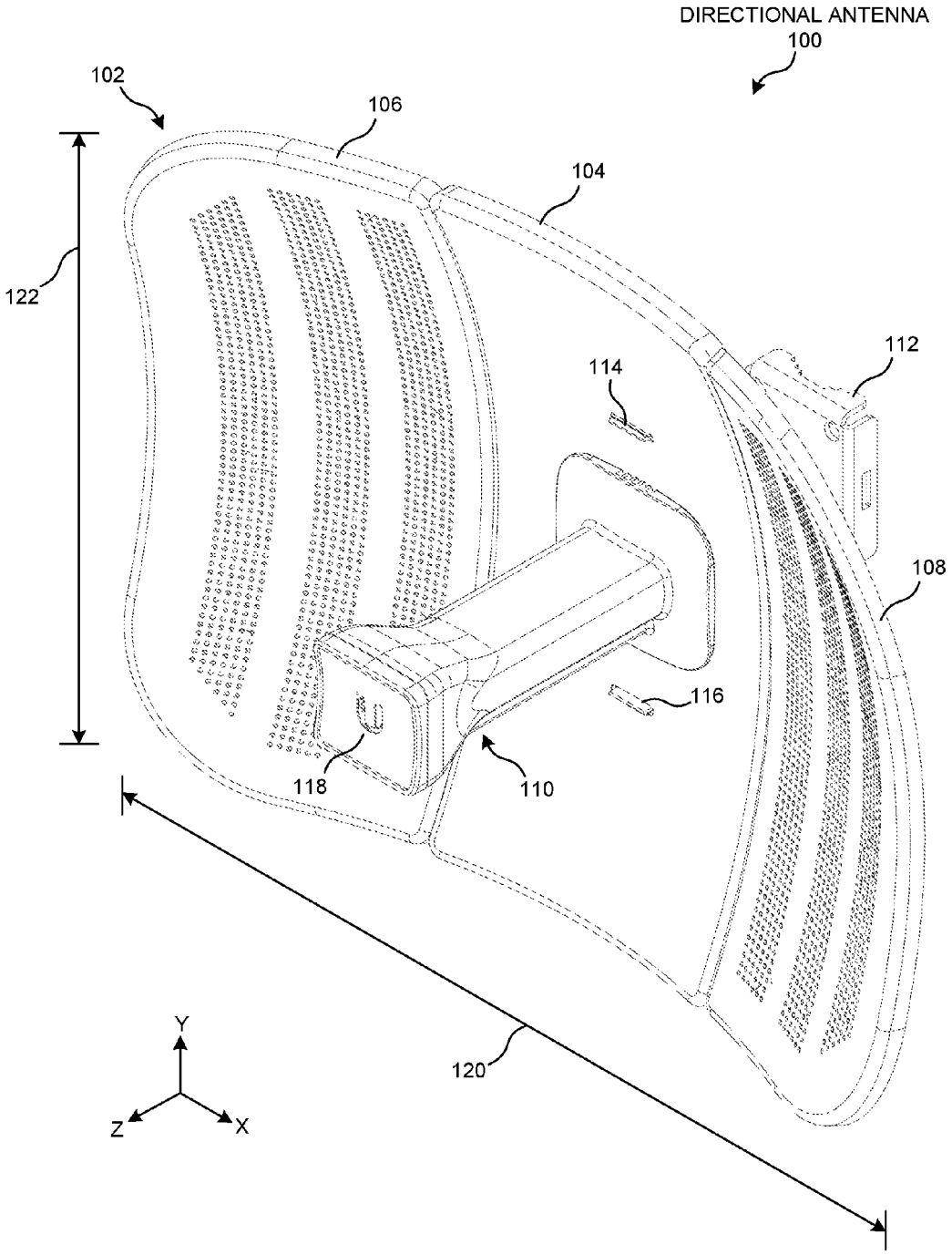
FIG. 1A illustrates a three-panel directional antenna in accordance with an embodiment.

FIG. 1A illustrates a three-panel directional antenna 100 in accordance with an embodiment. Antenna 100 can include a parabolic reflector 102 made up of a center panel 104 and two side panels 106 and 108, and can have a parabolic shape at least along an X-axis (e.g., the width of parabolic reflector 102). In some embodiments, parabolic reflector 102 may also have a parabolic shape along a Y-axis. Alternatively, parabolic reflector 102 may be a parabolic trough that may have a linear (or near-linear) shape along the Y-axis.

In some embodiments, parabolic reflector 102 may have a width 120 along an X-axis that is between 13.7" and 14.3", and a height 122 along a Y-axis that is between 10.2" and 10.7". For example, width 120 may be 14.25" and height 122 may be 10.51". Alternatively, width 120 may be 13.82" and height 122 may be 10.67". In an alternative embodiment, width 120 may be 13.82" and height 122 may be 10.67". Moreover, the depth (e.g., along a Z-axis) of assembled directional antenna 100, including a feed assembly 110 and a mounting assembly 112, can be between 7" and 7.5", such as approximately 7.24".

Antenna 100 can also include a feed assembly 110 that may be mounted on a concave side of parabolic reflector 102, and can include a mounting assembly 112 that may be coupled to a surface on a convex side of parabolic reflector 102. Parabolic reflector 102 may receive a radio signal that may travel toward the concave surface of parabolic reflector 102 approximately along the Z axis, and may reflect the radio signal toward feed pins near a front end 118 of feed assembly 110.

In some embodiments, side panels 106 and 108 may be coupled directly to center panel 104 via a set of fasteners (not shown). Alternatively or in addition to these embodiments, side panels 106 and 108 may be fastened next to center panel 104 via a multi-panel fastener (not shown) coupled to panels 102, 104, and 106, and coupled to mounting assembly 112. Moreover, feed assembly 110 can be mounted on the concave side of parabolic reflector 102, so that feed assembly 110 is substantially orthogonal to parabolic reflector 102. For example, feed assembly 110 may be coupled to the multi-panel fastener via an opening of center panel 104, or may be coupled directly to center panel 104.

Mounting assembly 112 can include a mounting assembly for mounting antenna 100 to a flat surface, or to a pole. The mounting assembly can include a square plate with prong and screw hole openings about its face, and two perpendicularly extending flanges from two opposing edges of the plate. Each flange may have an arcuate toothed cutout for mounting the bracket to a pole.

A parabolic reflector (e.g., parabolic reflector 102, or a sub-reflector near front-end 118) is generally a parabola-shaped reflective device, used to collect or distribute energy such as radio waves. The parabolic reflector typically functions due to the geometric properties of the paraboloid shape: if the angle of incidence to the inner surface of the collector equals the angle of reflection, then any incoming ray that is parallel to the axis of the dish (e.g., along the Z axis) will be reflected to a central point, or "locus" near front-end 118. Because many types of energy can be reflected in this way, parabolic reflectors can be used to collect and concentrate energy entering the reflector at a particular angle. Similarly, energy radiating from the "focus" to the dish can be transmitted outward in a beam that is parallel to the axis of the dish (e.g., along the Z axis). Antenna feed 110 may include an assembly that comprises the elements of an antenna feed mechanism, an antenna feed conductor, and an associated connector. The antenna feed system may include an antenna feed and a radio transceiver.

Figure 1B:
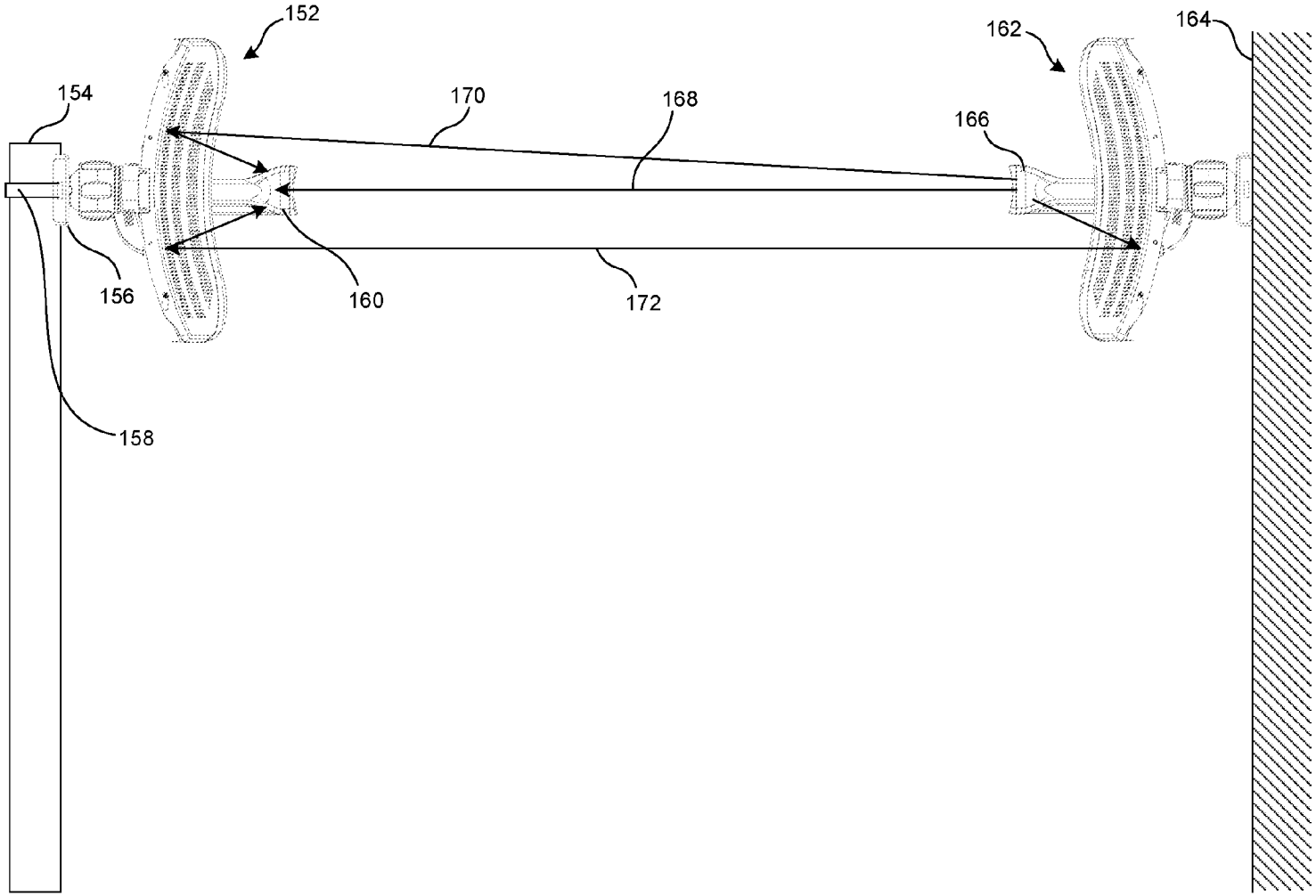
FIG. 1B illustrates an exemplary an exemplary radio signal exchange between two multi-panel directional antennas in accordance with an embodiment.

FIG. 1B illustrates an exemplary radio signal exchange between two multi-panel directional antennas in accordance with an embodiment. A directional antenna 152 may be fastened onto a pole 154 by wrapping a brace 158 through a pair of openings on a mounting brace 156 and around pole 154. Pole 154 can include, for example, a tree branch, a tree stem, or a segment of a radio tower, a telephone pole, a power-line pole, etc. Moreover, directional antenna 152 may be aimed at another directional antenna 162, which may be fastened against another surface 164, such as a building wall, or any other solid or rigid surface.

In some embodiments, directional antenna 162 may emit radio signals from a set of feed pins within an antenna feed 166. These radio signals can travel toward, and may be captured by, directional antenna 152. Some radio signals may travel directly from antenna feed 166 of antenna 162 toward an antenna feed 160 of antenna 152 (e.g., signal 168). Other radio signals may be reflected by the reflector of antenna 152 toward antenna feed 160 (e.g., signals 170 and 172), which may increase the signal strength of the signals received by directional antenna 152. In yet some further embodiments, the parabolic reflector of directional antenna 162 may also serve to increase the gain of the radio signals transmitted toward directional antenna 152 by reflecting radio signals emitted by antenna feed 166 toward directional antenna 152 (e.g., signal 172).

Figure 2A:
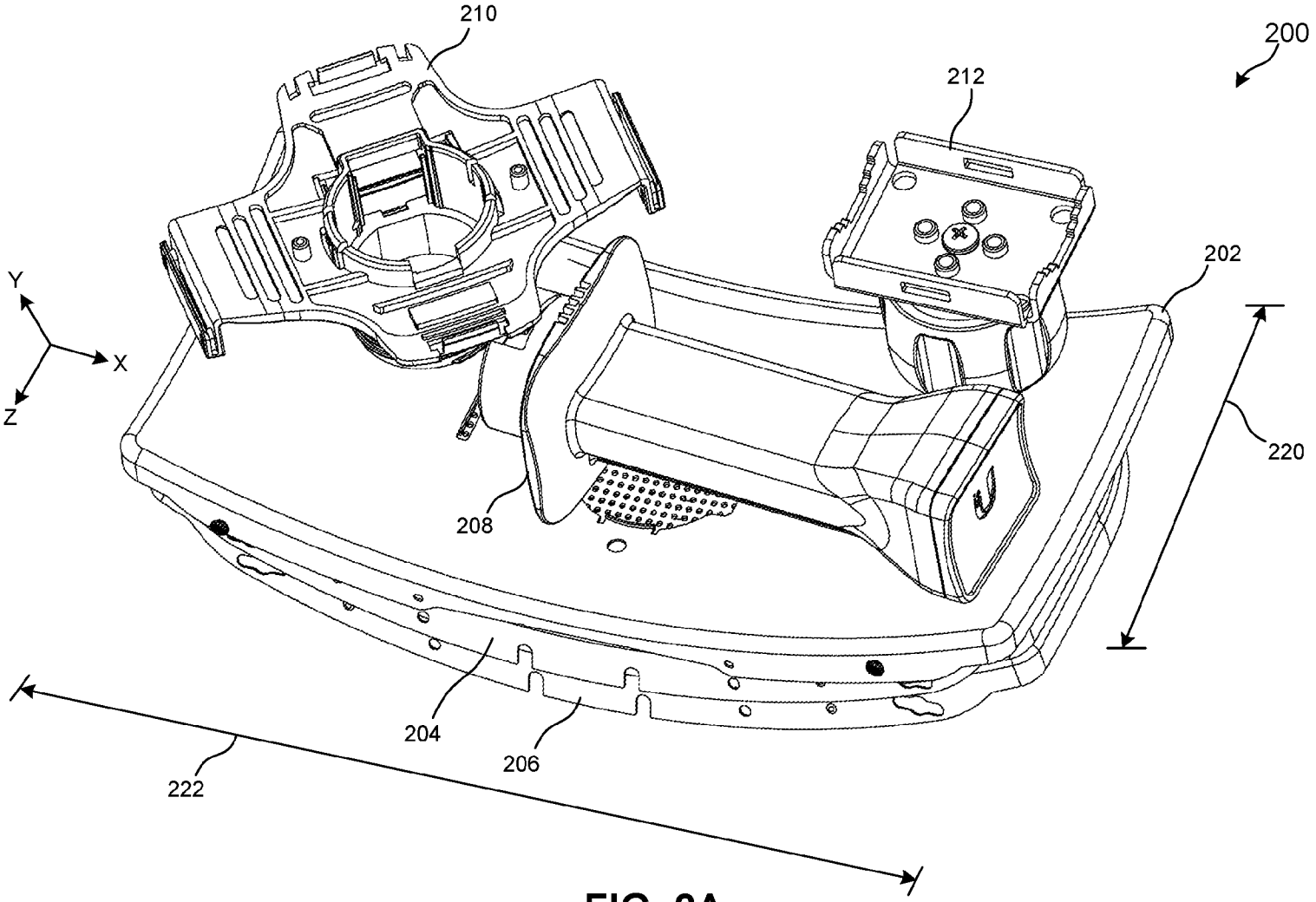
FIG. 2A illustrates a packaging configuration of a disassembled multi-panel directional antenna in accordance with an embodiment.

FIG. 2A illustrates a packaging configuration 200 of a disassembled multi-panel directional antenna in accordance with an embodiment. The antenna components can be packaged into a kit that includes a container (not shown) so that the components are arranged in configuration 200 within the container. Specifically, in packaging configuration 200, side panels 204 and 206 can be stacked on top of center panel 202. This configuration can result in a package base (e.g., along an X-axis and Z-axis) that may be approximately one-third the surface area of an assembled parabolic reflector. For example, recall that assembled parabolic reflector 102 of FIG. 1A has width 120 and height 122. The stack of panels 202, 204, and 206 can have depth 220 that is approximately one-third of width 120 for the assembled reflector 102, and can have length 222 that is approximately equal to height 122 of assembled reflector 102. In some embodiments, depth 220 can be approximately 5", and height can be between 10.2" and 10.7".

Moreover, feed assembly 208 can be configured so that its long side may be approximately parallel to (e.g., not orthogonal to) the surface of panels 202, 204, and/or 206. This configuration can result in the kit having a height along the Y-axis that may be less than the length of feed assembly 208 (e.g., the length of feed assembly 208 along the Z-axis). A multi-panel fastener 210 and mounting assembly 212 can be arranged in the container to be substantially coplanar with feed assembly 208.

The kit may also include protective cushioning and movement-limiting material (e.g., a packaging insert), diagnostic testing equipment, spare parts, assembly and/or repair tools, an instruction booklet, and any other information or parts that may facilitate assembling or deploying the directional antenna. In some embodiments, the container may be reusable, reclosable, constructed from a lightweight yet protective material, and dimensioned to closely enclose the contents of the kit. In some embodiments, once the parts of the kit are inserted into the container, the amount of free space left within the container may be equal to or less than twenty-five percent of the volume of the enclosed container.

Figure 2B:
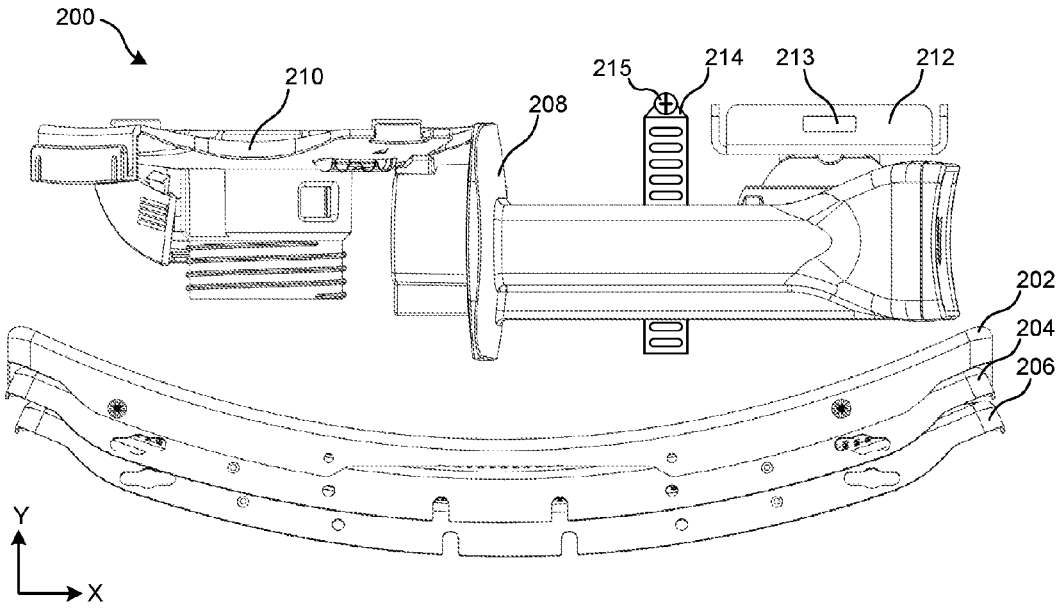
FIG. 2B illustrates a side view of the packaging configuration for the multi-panel antenna in accordance with an embodiment.

FIG. 2B illustrates a side view of packaging configuration 200 for the multi-panel antenna in accordance with an embodiment. Panels 202, 204, and 206 can be stacked on top of each other so that their concave side is facing upward along a Y-axis. In some embodiments, feed assembly 208 can be oriented over panel 202 so that the longest dimension of feed assembly 208 is parallel to the longest dimension of panel 202. In some embodiments, multi-panel fastener 210 may partially overlap a portion of feed assembly 208, and can be oriented approximately next to a proximal end of feed assembly 208.

Mounting assembly 212 can be oriented approximately next to the longest dimension of feed assembly 208, such as near the distal end of feed assembly 208. Moreover, a locking band can be oriented approximately next to mounting assembly 212. In some embodiments, locking band 214 can be used to mount mounting assembly 212 (and the directional antenna) on a pole by inserting locking band 214 into slots at two opposing side walls of mounting assembly 212, and wrapping locking band 214 around the pole. Once locking band 214 is in place, a user can tighten locking band 214 (e.g., shrink the circumference of locking band 214) by rotating a screw 215 on locking band 214.

Figure 2C:
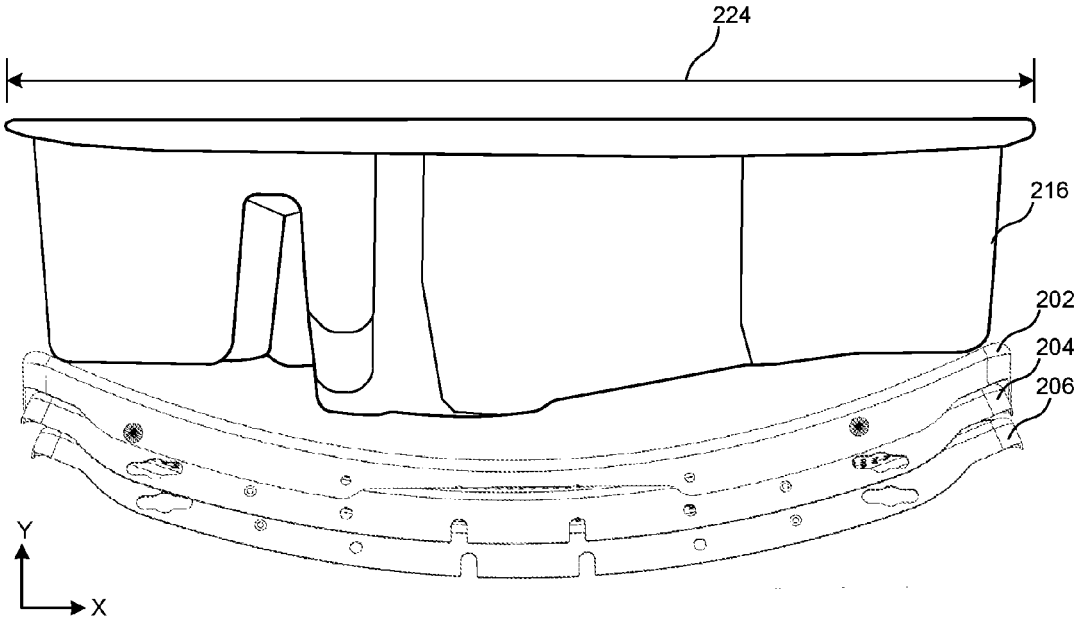
FIG. 2C illustrates a side view of a packaging insert 216 on top of stacked panels 202, 204, and 206 in accordance with an embodiment.

FIG. 2C illustrates a side view of a packaging insert 216 on top of stacked panels 202, 204, and 206 in accordance with an embodiment. Specifically, packaging insert 216 can have a length 224 that is approximately equal to length 222 of stacked panels 202, 204, and 206. For example, width 224 can be approximately 10.5". In some embodiments, a bottom surface of packaging insert 216 can have a convex curvature that approximately contours the concave curvature of reflector panel 202. This convex curvature increases the volume inside packaging insert 216 when compared to a packaging insert that has a flat (or near-flat) bottom surface.

Figure 2D:
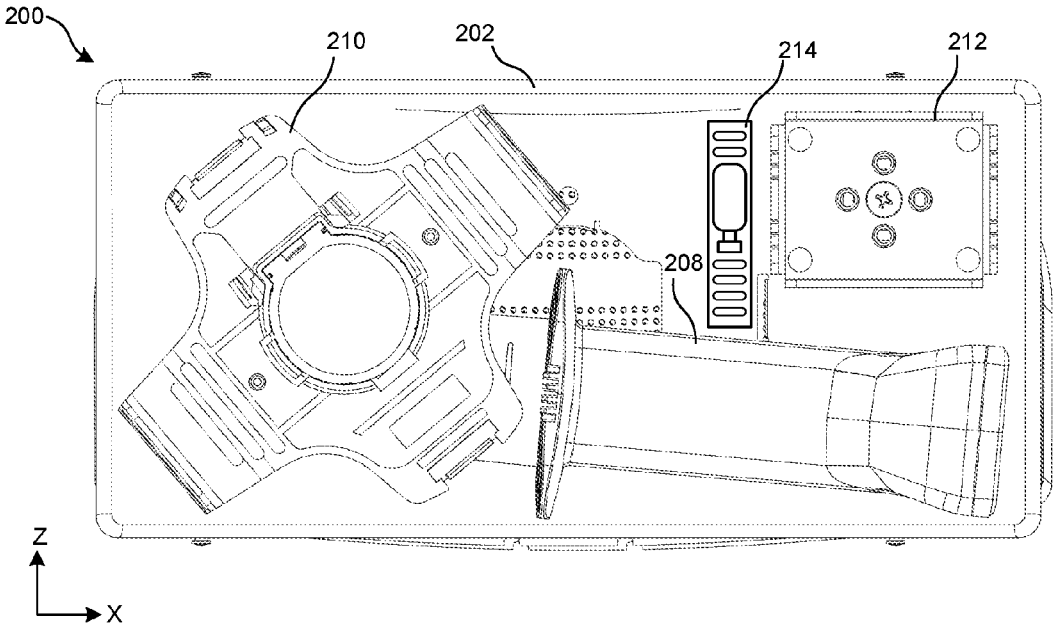
FIG. 2D illustrates a top view of a packaging configuration for the multi-panel antenna in accordance with an embodiment.

FIG. 2D illustrates a top view of packaging configuration 200 for the multi-panel antenna in accordance with an embodiment. Feed assembly 208 can be placed on top of panel 206 so that the longest side of feed assembly 208 is aligned along the longest side of panel 206 (e.g., approximately along the X-axis). Feed assembly 208, multi-panel fastener 210, mounting assembly 212, and locking band 214 can be arranged to occupy a surface area smaller than the surface of center panel 202.

Figure 2E:
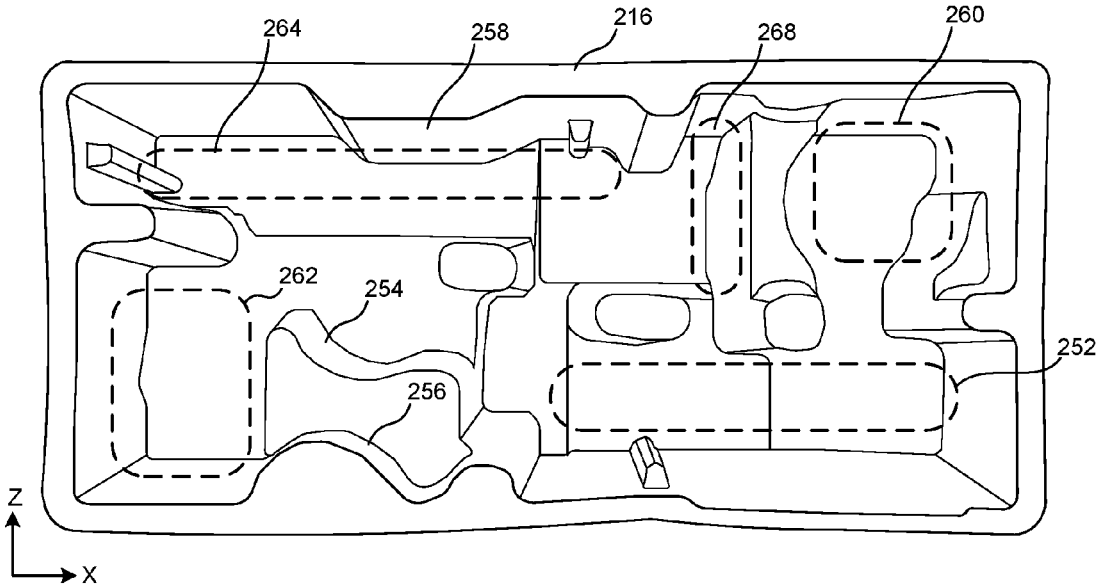
FIG. 2E illustrates a top view of the packaging insert in accordance with an embodiment.

FIG. 2E illustrates a top view of packaging insert 216 in accordance with an embodiment. Packaging insert 216 can include a slot 252 for packing feed assembly 208, a slot 260 for packing mounting assembly 212, a slot 262 for packing a power adapter (e.g., a power-over-Ethernet (PoE) adapter), a slot 268 for packing locking band 214, and a slot 264 for packing a power cord for the power adaptor. Packaging insert 216 can also include a side-wall 254 that holds a distal end of multi-panel fastener 210, and a side-wall 256 that holds a proximal end of multi-panel fastener 210. For example, multi-panel fastener 210 can slide into packaging insert 216 so that its distal end rests against side-wall 254, and so that its proximal end rests at least against side-wall 256. In some embodiments, the proximal end of multi-panel fastener 210 can rest between side walls 256 and 258.

Figure 2F:
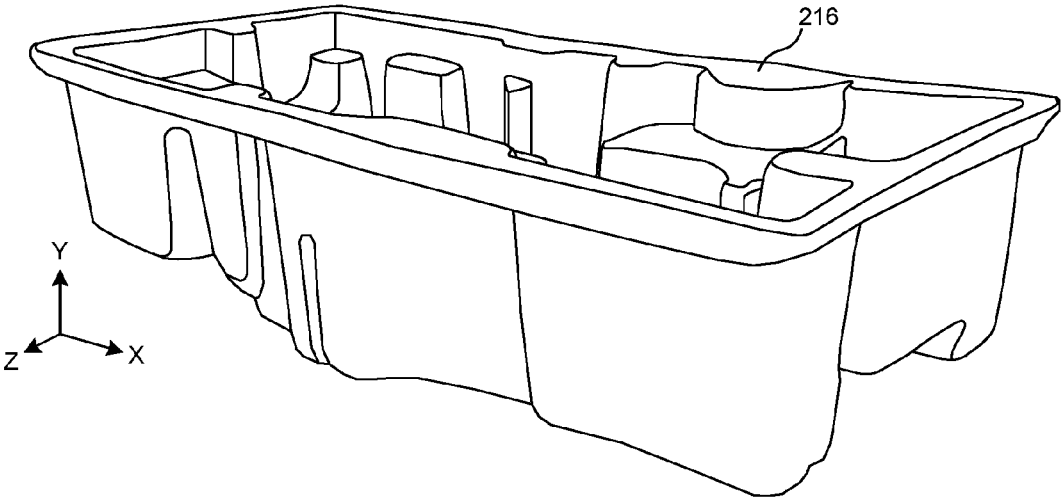
FIG. 2F illustrates an angled view of the packaging insert in accordance with an embodiment.

FIG. 2F illustrates an angled view of packaging insert 216 in accordance with an embodiment. In some embodiments, packaging insert 216 can be made by using a mold to create a contour on a pliable material. For example, packaging insert 216 include molded cardboard, molded plastic, or molded polystyrene.

Figure 2G:
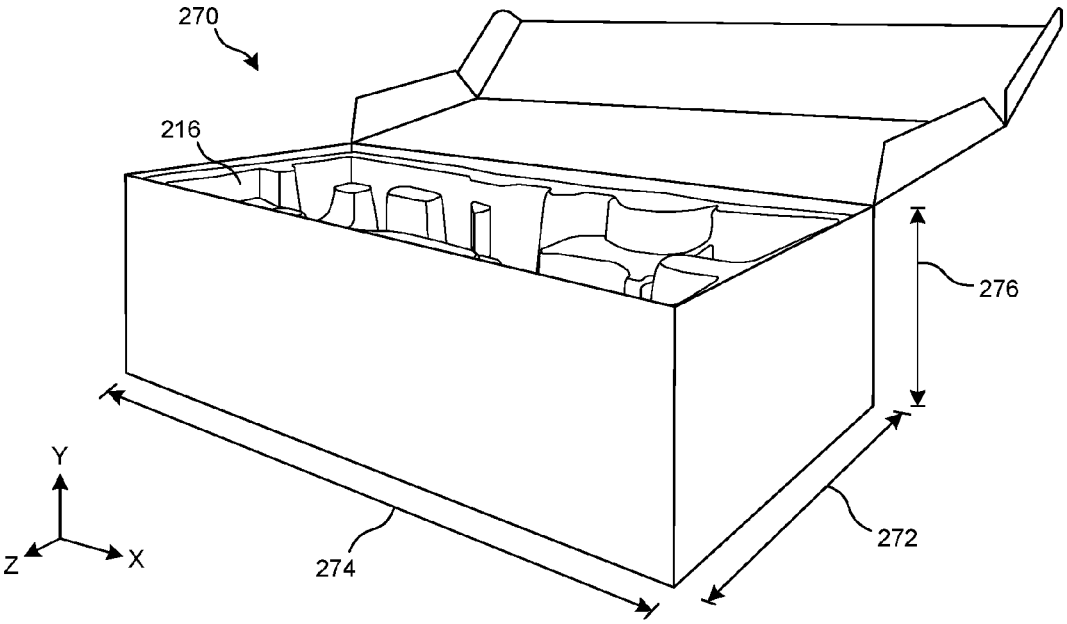
FIG. 2G illustrates an angled view of the packaging insert inside a container in a accordance with an embodiment.

FIG. 2G illustrates an angled view of packaging insert 216 inside a container 270 in a accordance with an embodiment. Container 270 can be used to contain and protect a multi-panel antenna kit. Specifically, the stack of panels 202, 204, and 206 can be placed into container 270 so that they rest on a floor inside container 270, and packaging insert 216 can be placed on top of the stacked panels. The remaining components of the kit can be inserted into their corresponding slots formed on insert 216. The slots created on insert 216 can prevent the kit components from shifting or bumping into each other while the kit is being shipped or otherwise transported to another location (e.g., transported to an antenna tower during deployment).

In some embodiments, container 270 can have a depth 272 between ten percent and twenty percent wider than one third of the width of the assembled multi-panel antenna. Moreover, container 270 can have a length 274 between five percent and fifteen percent longer than the height of the multi-panel antenna. Depth 272 can be between 5" and 6", length 274 can between 11" and 12", and container 270 can have a height 276 that is between 4" and 5". For example, depth 272 can be approximately 5.25", length 274 can be approximately 11.5", and height 726 can be approximately 4.5". Hence, the depth of container 270 can be approximately one third the width of an assembled antenna, and height 276 can be less than the depth of the assembled antenna (e.g., when packaging antenna 100 with a width 14.25" and depth 7.24").

Figure 3A:
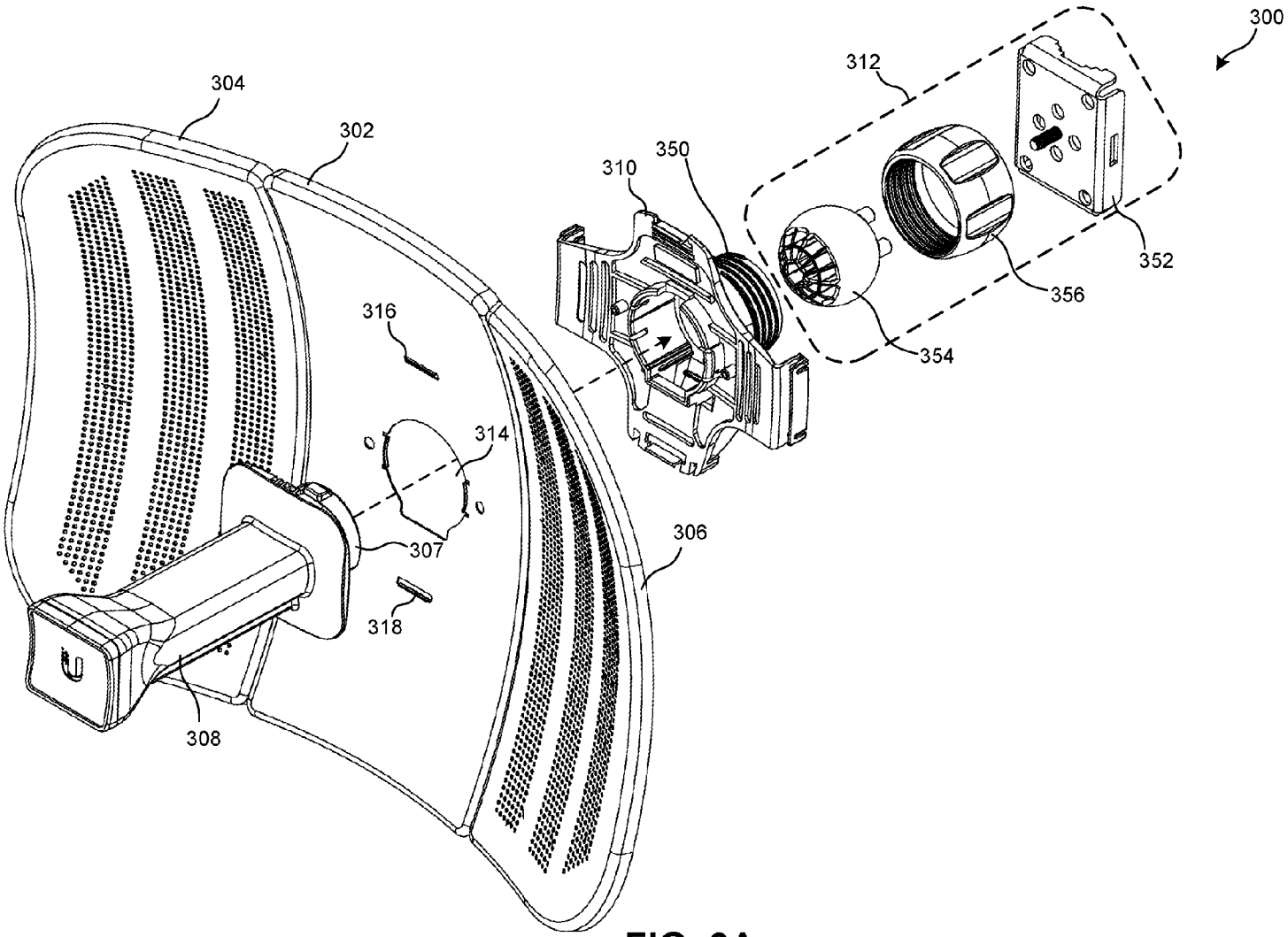
FIG. 3A illustrates an exploded view of the three-panel antenna in accordance with an embodiment.

FIG. 3A illustrates an exploded view of the three-panel antenna system 300 in accordance with an embodiment. A center panel 302 can include a set of openings 316 and 318 for coupling a multi-panel fastener 310 to a convex side (e.g., the rear side) of center panel 302. In some embodiments, openings 316 and 318 may be a part of a snap-fit coupler that can secure multi-panel fastener 310 onto the convex side of antenna system 300.

Center panel 302 can also include an opening 314 for passing a proximal end 307 of a feed assembly 308 toward multi-panel fastener 310. Coupling proximal end 307 of feed assembly 308 with multi-panel fastener 310 may secure feed assembly 308 to antenna system 300, and may also further secure multi-panel fastener 310 to panels 302, 304, and 306. Multi-panel fastener 310 can include a threaded coupler 350 that can be used to couple multi-panel fastener 310 to a mounting assembly 312, or to any other type of mountain equipment, such as a threaded pipe.

In some embodiments, mounting assembly 312 can include a mounting bracket 352, a ball joint 354 that can be coupled to mounting bracket 352 (e.g., with a screw). Mounting assembly 312 can also include a lock nut 356 that may be positioned between mounting bracket 352 and ball joint 354, and can mate with threaded coupler 350 of multi-panel fastener 310. Ball joint 354 can include a curved convex surface (e.g., a spherical, or near-spherical surface) that can mate with a central orifice (e.g., a curved concave surface) at threaded coupler 350, which can allow a user to adjust an azimuth, elevation, or rotational angle of the parabolic reflector. To lock the parabolic reflector into place, the user can tighten threaded coupler 356 to threaded coupler 350, which increases the friction between ball joint 354 and threaded coupler 350. Coupling threaded coupler 356 to threaded coupler 350 effectively couples multi-panel fastener 310 (and the parabolic reflector) to mounting assembly 312, and the increased friction locks the parabolic reflector into place.

In some embodiments, the panels may be constructed from a material suitable for reflecting radio signals toward feed assembly 308, such as aluminum. Aluminum may provide advantages over other materials, such as a relatively high strength-to-weight ratio, and a relatively simpler manufacturing process. Aluminum may also be polished to increase the reflectivity of the surface.

Other materials may also be used to fabricate panels 302, 304, and/or 306, possibly at the expense of a higher material cost or manufacturing complexity. For example, panels 302, 304, and/or 306 may be manufactured from steel that may be finished with a nickel or chromium plating. As another example, panels 302, 304, and/or 306 may be manufactured from metal, ceramic, and/or plastic composites that may have an aluminum-plated surface or other reflective overlays. While the examples above describe manufacturing reflector panels using aluminum, nickel, and/or chromium, any other materials that have the aforementioned structural and reflective properties may be used in addition to, or in place of, aluminum, nickel, and/or chromium.

In some embodiments, reflector panels 302, 304, and/or 306 may have the same or different surface features and patterns. For example, center reflector panel 302 may have a solid surface that is free of any features that may create a grid, screen, or mesh-like appearance (e.g., a grid of indents, openings, or through-holes). Manufacturing a solid surface may be achieved with a simpler process than manufacturing a mesh-like surface, at the cost of retaining unnecessary weight. On the other hand, side reflector panels 304 and 306 may be manufactured with a plurality of openings that may produce a grid, screen, or mesh-like appearance. These openings can minimize the weight of side reflector panels 304 and 306, and may minimize environmental loads on panels 304 and 306, such as from wind, snow, rain, and ice. In some embodiments, the size of the openings may have a diameter less than 1/10 of a wavelength for the radio signals that are to be reflected toward, and captured by, a set of feed pins in feed assembly 308. Such size constraints for the openings may allow side panels 304 and 306 to maintain similar, if not equivalent, reflective properties as the solid surface of central panel 302.

Panels 302, 304, and 306 may be connected to each other in a simple assembly process that does not compromise the rigidity or integrity of the parabolic reflector when exposed to wind, rain, and/or other elemental forces. The simple assembly process should be simple enough for an untrained technician to assemble directional antenna system 300 in the field. For example, the assembly process may be realized by a connecting system or locking mechanisms that may minimize the use of additional parts, tools, time, and skill required to lock and/or unlock side panels 304 and 306 to/from center panel 302. One or more types of known locking mechanisms and methods may be used to connect side panels 304 and 306 to center panel 302, regardless of whether panels 302, 304, and 306 are aligned vertically or horizontally.

The locking mechanisms may enable panels 302, 304, and 306 to be fastened to each other, for example, by snapping them together, hooking or sliding them to interlock, etc. In some embodiments, once assembled, panels 302, 304, and 306 may be permanently interlocked. In some other embodiments, the panels may be separated simply by reversing the steps of the assembly process, which may involve also triggering a release before separating two adjoined components of directional antenna system 300.

Figure 3C:
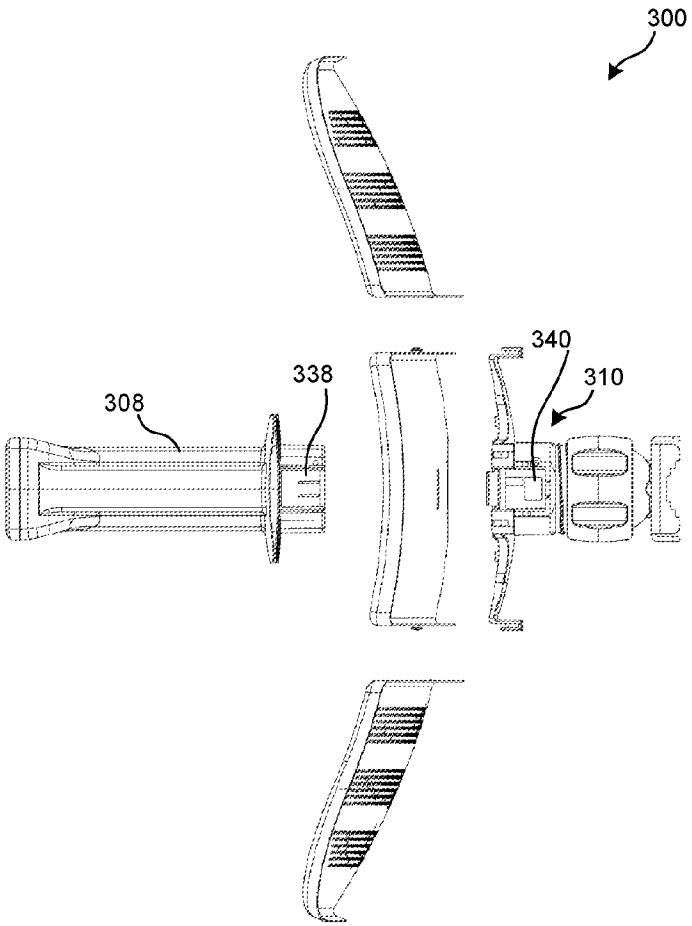
FIG. 3C illustrates an exploded bottom view of the three-panel antenna in accordance with an embodiment.
Figure 3B:
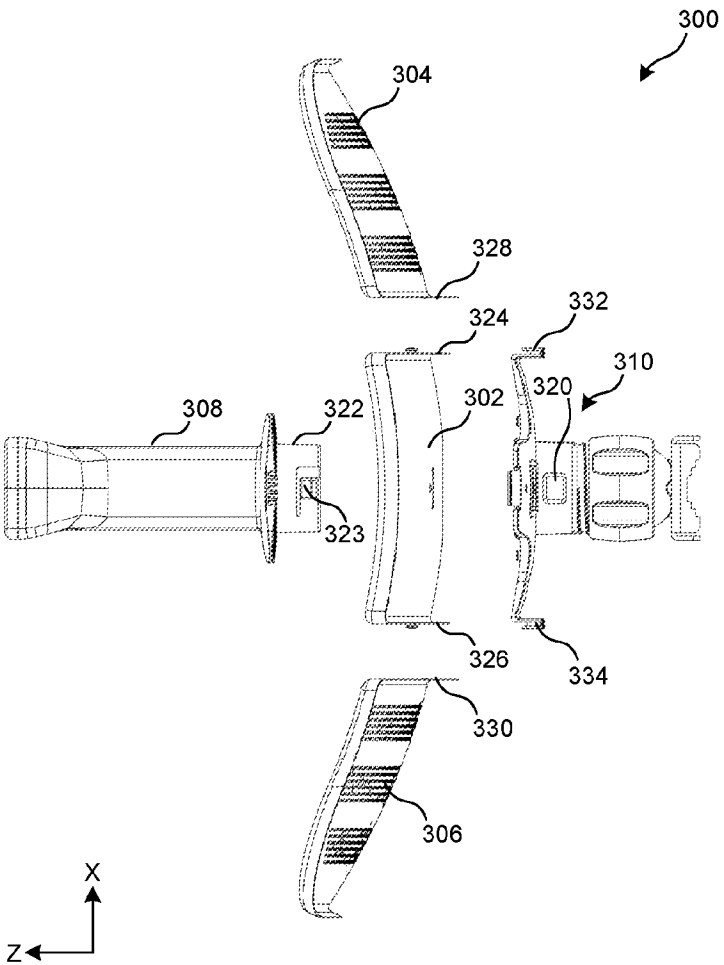
FIG. 3B illustrates an exploded top view of the three-panel antenna in accordance with an embodiment.

FIG. 3B illustrates an exploded top view of three-panel directional antenna system 300 in accordance with an embodiment. Specifically, center panel 302 can include angled edges 324 and 326 that may extend from a rear (convex) surface of antenna system 300 from opposing sides of center panel 302. Side panels 304 and 306 can also include angled edges 328 and 330, respectively, along at least one side that may be fastened to center panel 302. Angled edge 328 of side panel 304 can be mated with angled edge 324 of center panel 302, and angled edge 330 of side panel 306 can be mated with angled edge 326 of center panel 302. In some embodiments, angled edges 324 and 328 can include couplers for fastening side panel 304 to center panel 302. Similarly, angled edges 326 and 330 can include couplers for coupling side panel 306 to center panel 302. For example, angled edges 324 and 328 can include one or more post and slot couplers.

In some embodiments, multi-panel fastener 310 can include a pair of sleeves 332 and 334 that can further fasten side panels 304 and 306 to center panel 302. For example, after side panels 304 and 306 are coupled to center panel 302, sleeve 332 can slide over a portion of angled edges 324 and 328, and sleeve 334 can slide over a portion of angled edges 326 and 330.

Multi-panel fastener 310 can also include an opening 320, which can be used to fasten feed assembly 308 to multi-panel fastener 310. In some embodiments, feed assembly 308 can include a wedge anchor 322, or any other type of fastener that can interlock with opening 320. Wedge anchor 322 allows a user to secure multi-panel fastener 310 to center panel 302 without requiring additional tools, such as a screw and screw driver. A proximal end of feed assembly 308 can be passed through an opening of center panel 302 and inserted into an opening of multi-panel fastener 310, at which point wedge anchor 322 can mate with opening 320 to fasten feed assembly 308 to multi-panel fastener 310. Wedge anchor 322 can include a release button 323 that protrudes past opening 320 on a top surface of multi-panel fastener 310. A user may press on release button 323 to disengage wedge anchor 322 from opening 320, and release feed assembly 308 from multi-panel fastener 310, without requiring additional tools for disassembling antenna system 300.

FIG. 3C illustrates an exploded bottom view of three-panel directed antenna system 300 in accordance with an embodiment. Specifically, feed assembly 308 can house a radio transceiver and one or more feed pins. The radio transceiver can generate RF signals that radiate from the antenna feed pins at a distal end of feed assembly 308.

A proximal end of feed assembly 308 can include an interface port 338 that can provide power and/or a network connection to the radio transceiver housed inside feed assembly 308. In some embodiments, interface port 338 can include an Ethernet port (e.g., a Power-over-Ethernet port), a Universal Serial Bus (USB) port, an IEEE 1394 (e.g., Firewire) port, a Thunderbolt port, or any other interface port now known or later developed. Multi-panel fastener 310 can include an opening 340 for exposing network port 338. When feed assembly 308 is mated with multi-panel fastener 310, interface port 338 may be exposed via opening 340.

Figure 3D:
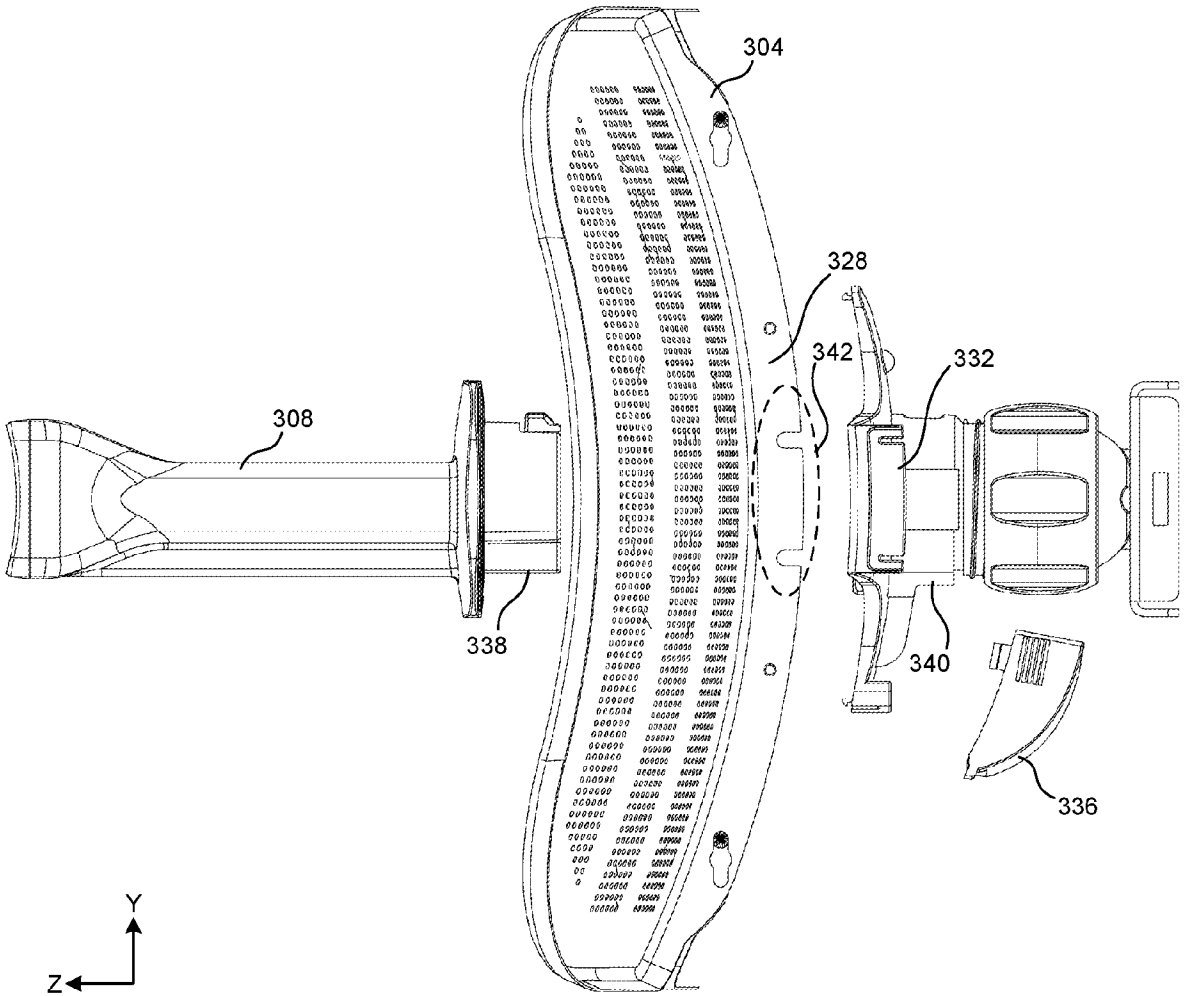
FIG. 3D illustrates an exploded side view of the three-panel antenna in accordance with an embodiment.

FIG. 3D illustrates an exploded side view of three-panel directed antenna system 300 in accordance with an embodiment. Specifically, angled edge 328 of side panel 304 can include an edge segment 342. When multi-panel fastener 310 is fastened to center panel 302, sleeve 332 may slide over edge segment 342 to prevent panel 304 from sliding along a Y-axis.

Figure 3E:
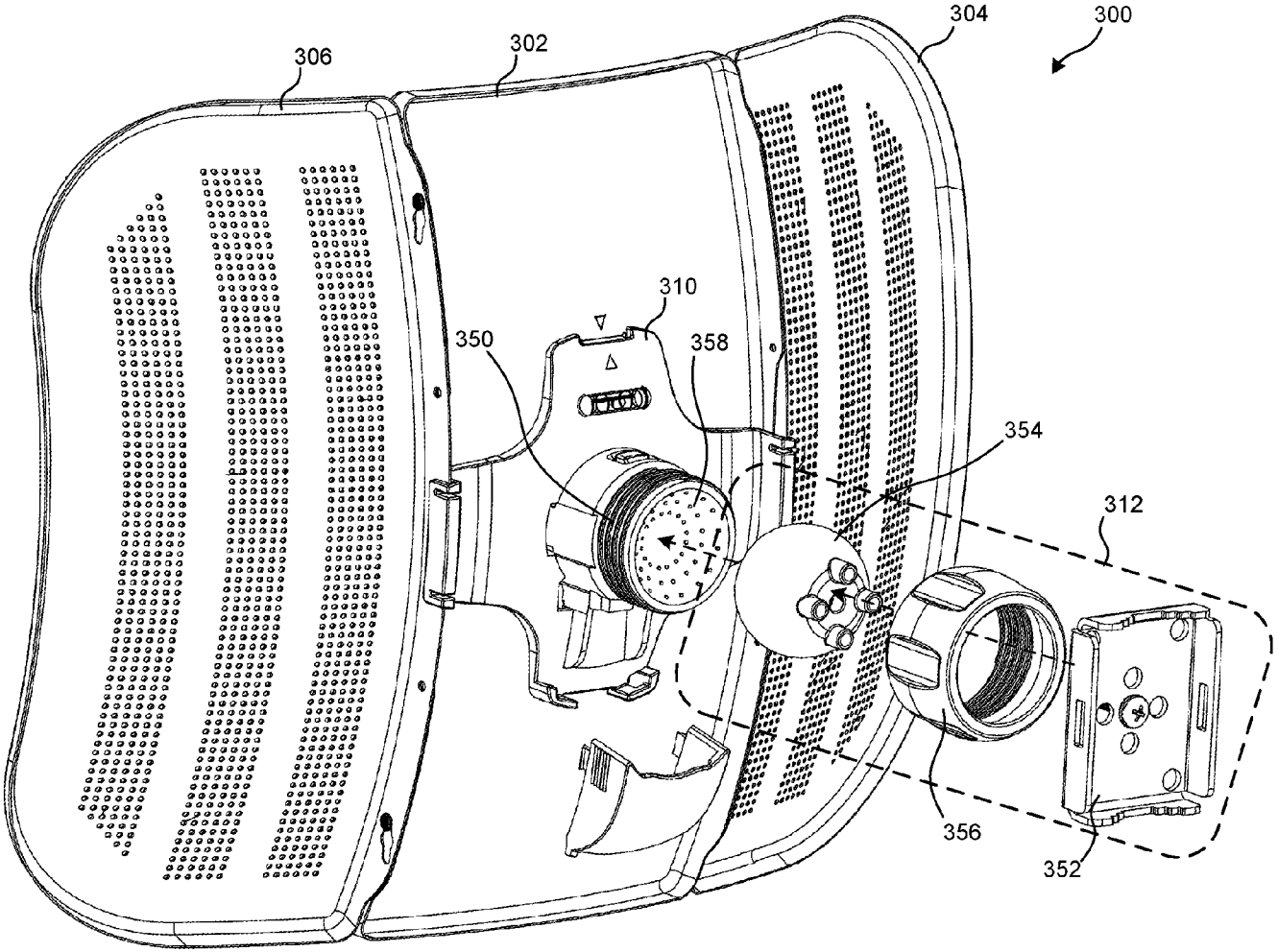
FIG. 3E illustrates a curved receptacle surface on a distal end of a multi-panel fastener in accordance with an embodiment.

FIG. 3E illustrates a curved receptacle surface 358 on a distal end of multi-panel fastener 310 in accordance with an embodiment. The proximal end of multi-panel fastener 310 can be coupled to center panel 302, and the distal end can include a central orifice 358 that may be coupled to ball joint 354, and can include a threaded circular outer surface for screwing a lock nut 356 to threaded coupler 350 on the distal end of multi-panel fastener 310. In some embodiments, central orifice 358 can include a curved concave surface, with a curvature substantially similar to the curved convex surface of ball joint 354.

Screwing lock nut 356 to threaded coupler 350 may effectively secure ball joint 354 to multi-panel fastener 310. Ball joint 356 can be coupled to mounting bracket 352 via a screw 360, and can include a set of prongs (e.g., four prongs positioned in a square configuration) that insert into a corresponding set of holes on mounting bracket 352 to prevent ball joint 356 from rotating. Moreover, the curved surface of ball joint 354 may be pressed against the curved surface of central orifice 358 by tightening (e.g., via a rotating motion) lock nut 356 to threaded coupler 358 so that ball joint 354 is in between lock nut 354 and threaded coupler 350.

In some embodiments, mounting assembly 310 may include a door 360 to cover a network cable (not shown) that may be connected to antenna feed assembly 308 (not shown). In the illustrated embodiment, door 360 may be crescent-shaped, and may be attached to a base of multi-panel fastener 310 and/or to the convex outer side of center reflector panel 302.

Figure 4A:
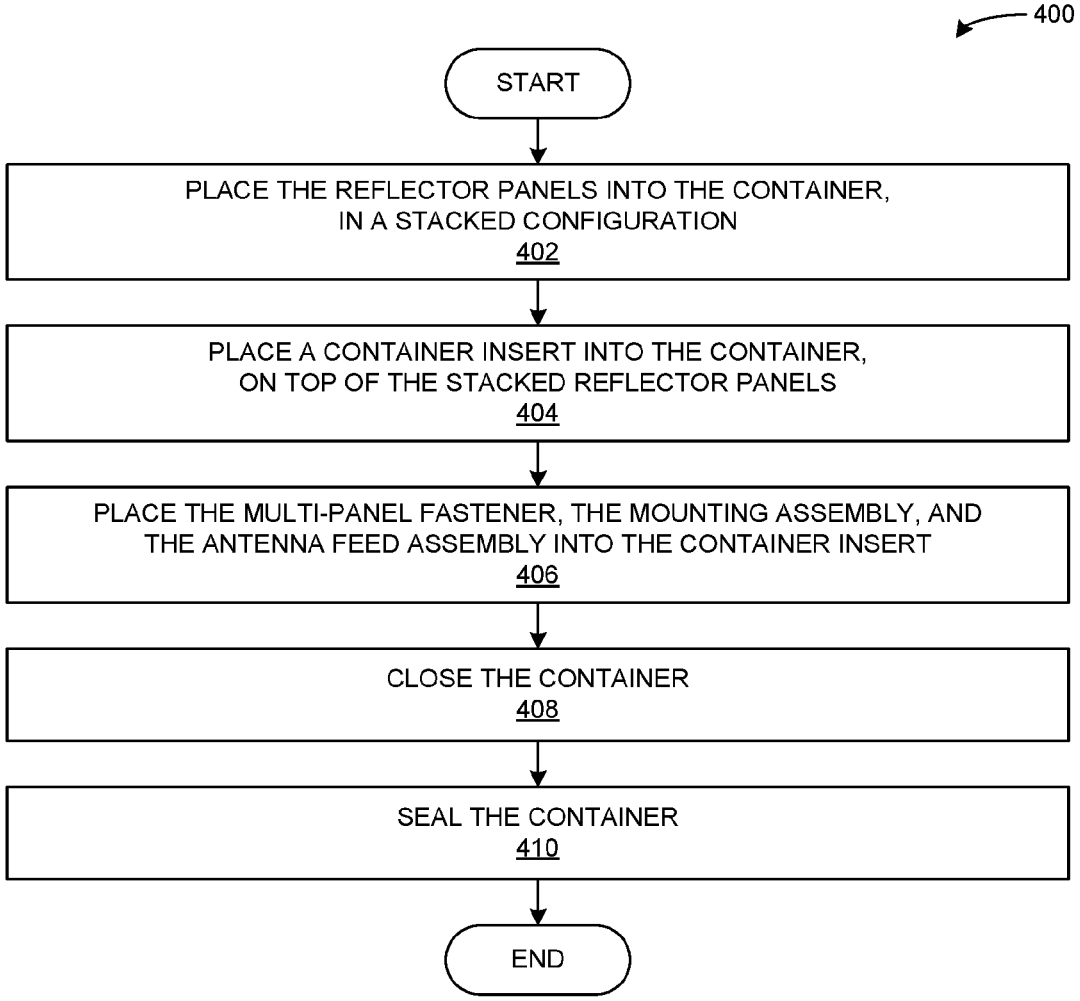
FIG. 4A illustrates a process for packaging a multi-panel directional antenna 400 in accordance with an embodiment.

FIG. 4A illustrates a process 400 for packaging a multi-panel directional antenna 400 in accordance with an embodiment. A factory worker may place the reflector panels into a container, in a stacked configuration (operation 402), and may place a packaging insert into the container, on top of the stacked reflector panels (operation 404). The factory worker may also place the mounting assembly and the antenna feed assembly into the packaging insert, either before or after placing the insert into the container (operation 406). The factory worker may then close the container (operation 408) and can seal the container (operation 410).

In some embodiments, the individual panels may be wrapped in plastic, polystyrene foam (e.g., Styrofoam), bubble wrap, paper, or any shielding or dampening material that may prevent the panels from getting scratched or bumping into each other during shipping. Moreover, Also, in some embodiments, placing the panels into the container may involve sliding the individual panels into slots within a packaging insert at a bottom of the container, such that the slots may cause the panels to stand on one edge, with the concave side of the individual panels facing one side of the box. Moreover, securing the panels within the container may involve sliding another packaging insert on a top edge of the individual panels, to prevent the panels from bumping into each other during shipping. The packaging inserts at the bottom surface and top surface of the container may include slots holding the mounting assembly and antenna feed assembly to prevent them from bumping onto each other or the reflector panels during shipping.

Figure 4B:
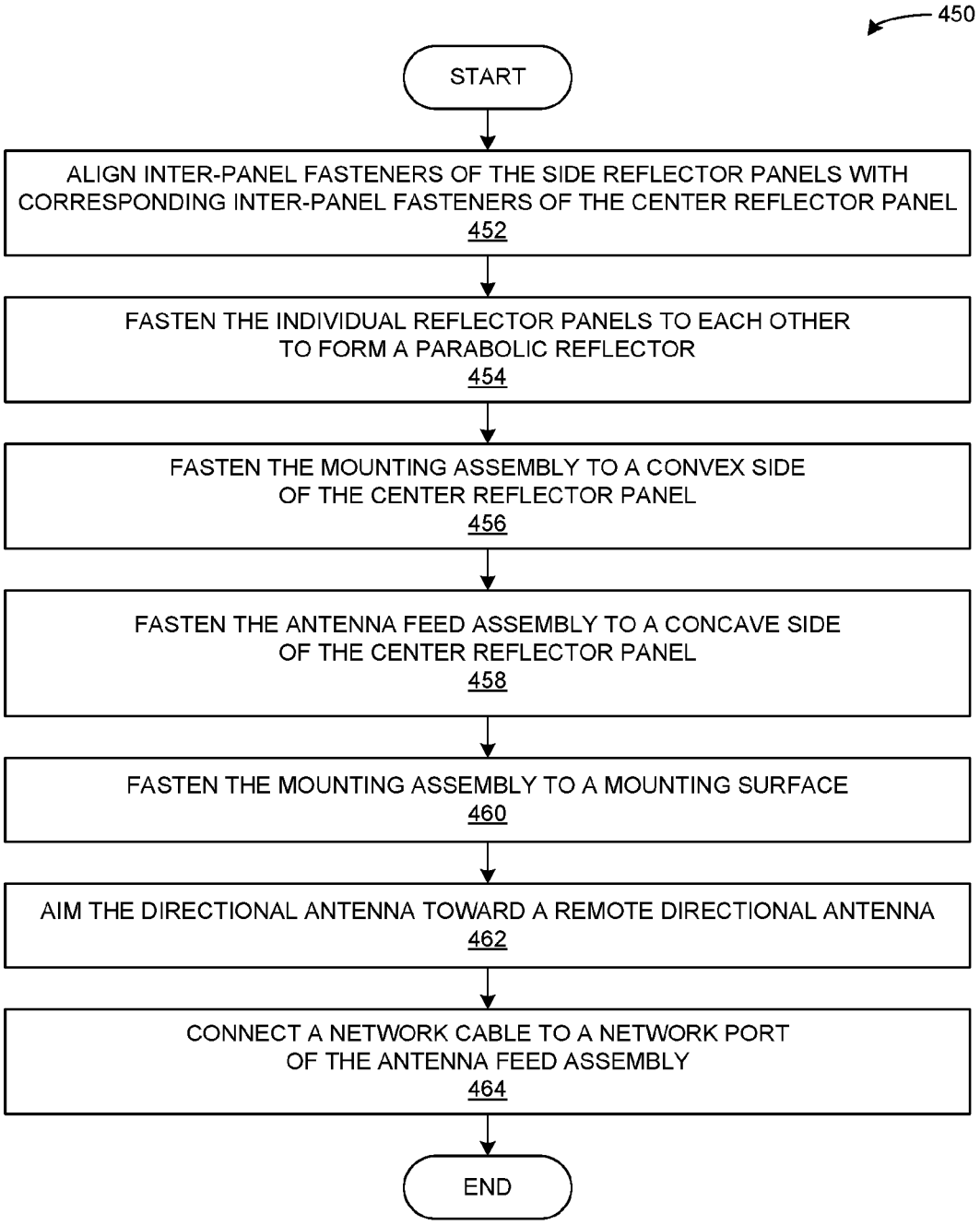
FIG. 4B illustrates a process for assembling a multi-panel directional antenna 400 in accordance with an embodiment.

FIG. 4B illustrates a process 450 for assembling a multi-panel directional antenna 400 in accordance with an embodiment. An end-user may install the directional antenna by first aligning inter-panel fasteners of the side reflector panels with corresponding inter-panel fasteners of the center reflector panels (operation 452). In some embodiments, the inter-panel fasteners may include post and slot couplings along an angled edge of the reflector panels.

The end-user may then fasten the individual reflector panels to each other to form a parabolic reflector (operation 454). If the parabolic reflector is formed from three individual panels, fastening the panels may involve fastening the side reflector panels to the center reflector panel. The end-user may also fasten the mounting assembly to a convex side of the center reflector panel (operation 456), and may fasten the antenna feed assembly to a concave side of the center reflector panel (operation 458).

The end-user may then mount the directional antenna onto a mounting surface, such as a wall or a pole, by fastening the mounting assembly to the mounting surface (operation 460). At this point, the end-user can put the antenna to use by aiming the directional antenna toward a remote directional antenna (operation 462), and connecting a network cable to a network port of the antenna feed assembly (operation 464)

Figure 5A:
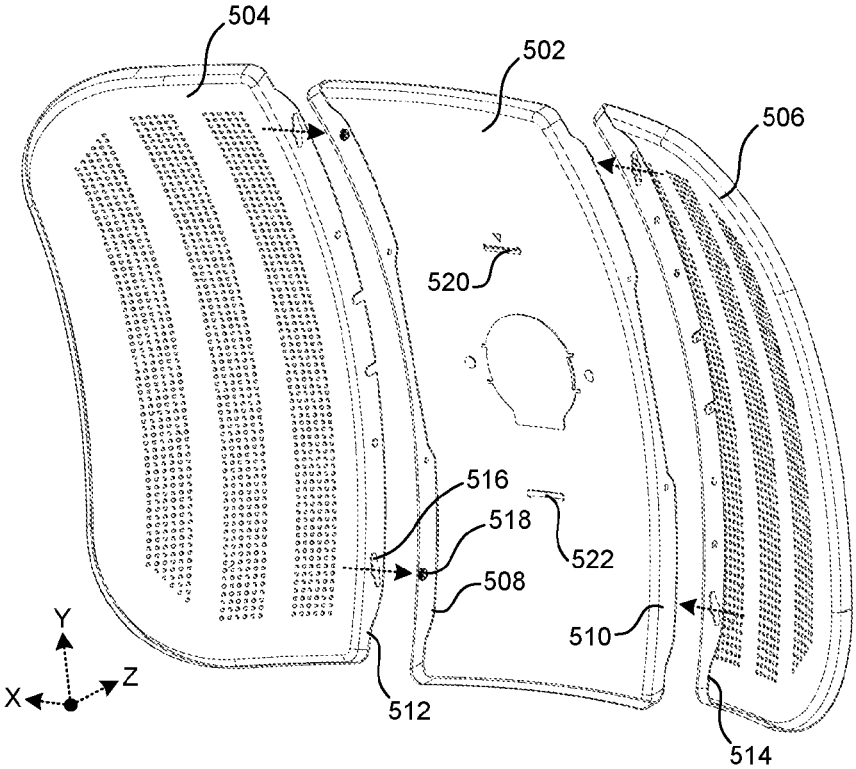
FIG. 5A illustrates a set of panels being aligned during a panel assembly process in accordance with an embodiment.

FIG. 5A illustrates a set of panels being aligned during a panel assembly process in accordance with an embodiment. Specifically, side panels 504 and 506 can be moved toward a center panel 502, at a slightly higher (or lower) elevation than center panel 502 so that a set of posts along angled edges 508 and 510 can pass through corresponding slots along angled edges 512 and 514.

In some embodiments, a slot and post coupler implements an inter-panel fastener that allows a side panel to be coupled to center panel 502. For example, a slot 516 can include an elongated shape, with a wider opening along a segment of slot 516 (e.g., along a center segment of slot 516). Moreover, a corresponding post 518 can include a wider head at the tip than along the rest of post 518. The wider opening along slot 516 may be sufficiently wide to allow the head of post 518 to pass through slot 516 so that angled edge 508 and the head of post 518 are at opposing sides of angled edge 512. Moreover, the remainder of slot 516 may be sufficiently narrow to prevent the head of post 518 from passing through slot 516 when the head of post 518 is not aligned with the wider opening of slot 516.

Figure 5B:
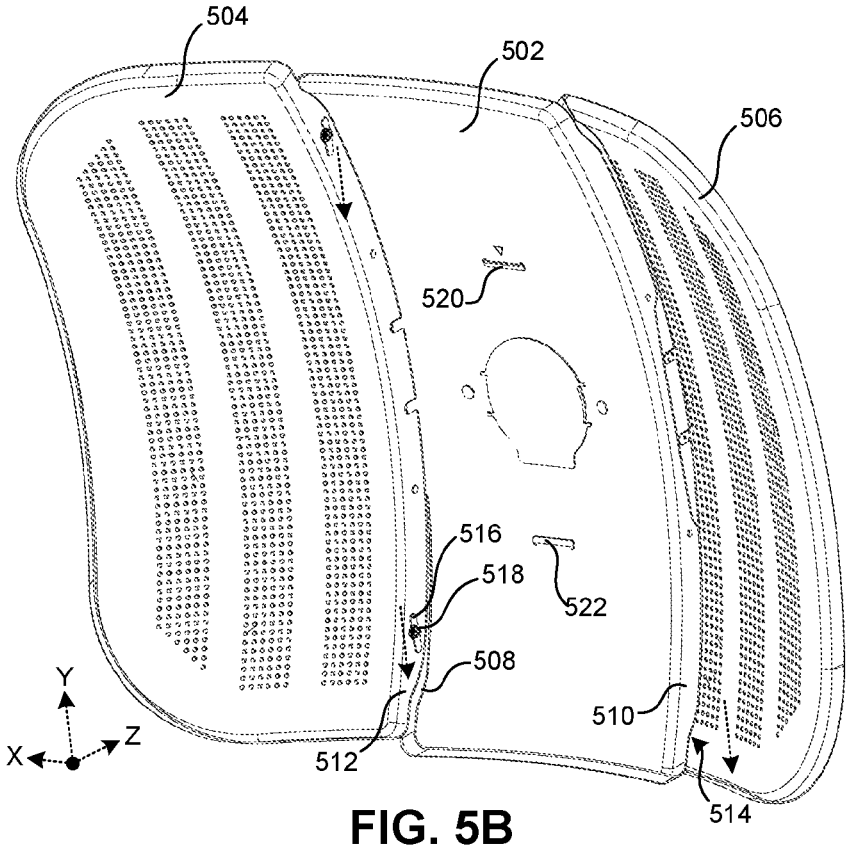
FIG. 5B illustrates a set of panels being fastened during a panel assembly process in accordance with an embodiment.

FIG. 5B illustrates a set of panels being fastened during a panel assembly process in accordance with an embodiment. Once angled edges 512 and 514 of side panels 504 and 506 are in contact with angled edges 508 and 510 of center panel 502, side panels 506 and 508 may be slid along a Y-axis (e.g., downward) to fasten a set of couplings along the angled edges. For example, sliding panel 504 along the Y-axis (e.g., downward) can cause the wider head of post 518 to slide onto a narrow segment (e.g., a top segment) of slot 516 on panel 504.

Fastening the couplings along angled edges 508 and 512 can prevent panel 504 from moving along an X-axis and/or a Z-axis with respect to panel 502, but may not prevent panel 504 from moving along at least one direction along the Y-axis (e.g., downward). In some embodiments, an additional fastener may be used to secure side panels 504 and 506 to center panel 502 along at least the Y-axis.

Figure 5C:
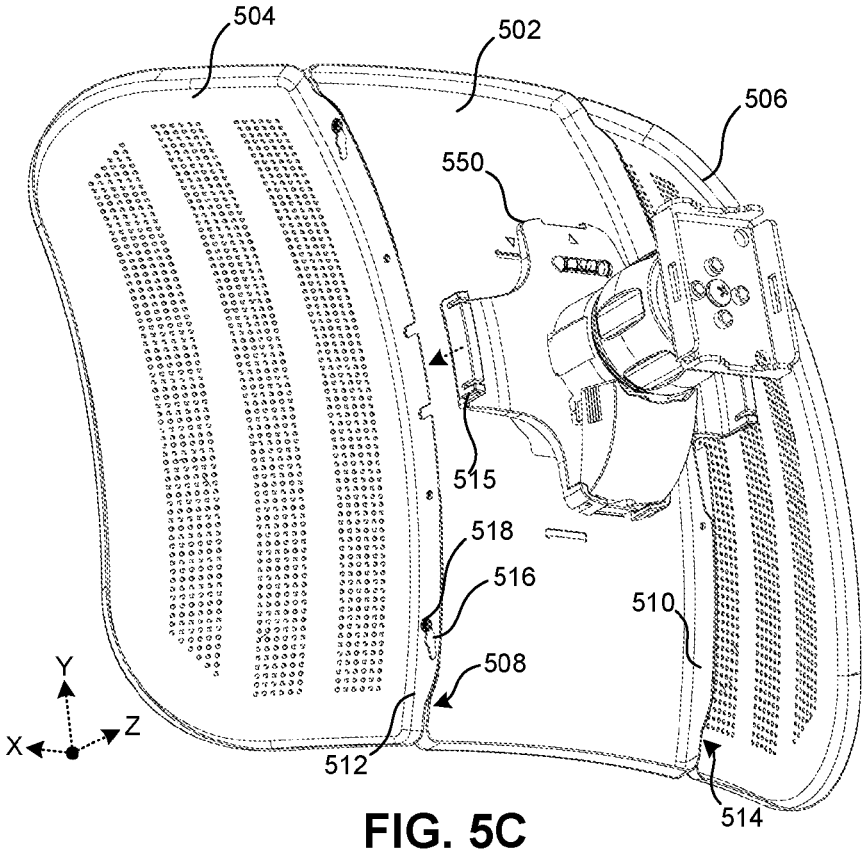
FIG. 5C illustrates a mounting assembly being fastened to a set of panels during a panel assembly process in accordance with an embodiment.

FIG. 5C illustrates a mounting assembly being fastened to a set of panels during a panel assembly process in accordance with an embodiment. Specifically, a multi-panel fastener 550 may be fastened to center panel 502, which can also prevent side panels 504 and 506 from moving along a Y-axis. Multi-panel fastener 550 can include a sleeve 515 that can slide over an edge segment 512 of panel 504, and can include another sleeve that may slide over an edge segment of panel 506 (not shown).

In some embodiments, center panel 502 and multi-panel fastener 550 can include a set of fasteners for fastening multi-panel fastener 550 to center panel 502, such as a wedge anchor, a snap fastener, or any other fastener that may produce a rigid coupling between center panel 502 and multi-panel fastener 550. For example, center panel 502 can include a pair of openings 520 and 522 (as shown in FIG. 5A) for coupling multi-panel fastener 510 to center panel 502. Multi-panel fastener 550 can include a set of fasteners (e.g., wedge anchors) that can fasten multi-panel fastener 550 to openings 520 and 522, respectively.

Figure 5D:
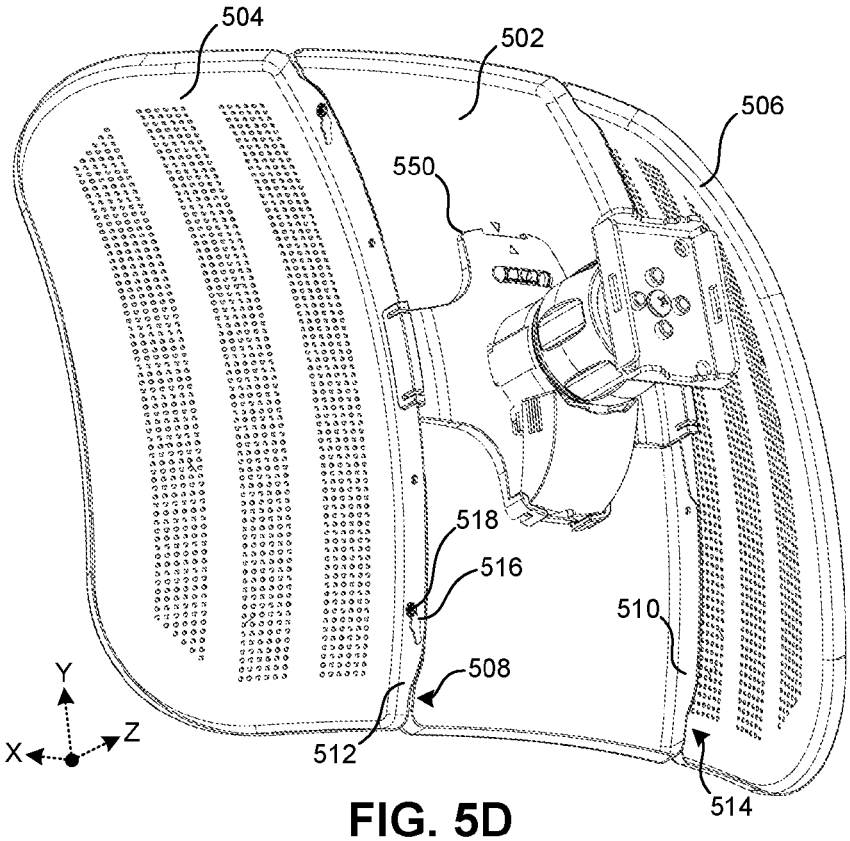
FIG. 5D illustrates a rear angled view of an assembled multi-panel directional antenna in accordance with an embodiment.

FIG. 5D illustrates a rear angled view of an assembled multi-panel directional antenna 500 in accordance with an embodiment. Specifically, the fasteners along the angled edges of panels 502, 504, and 506 can fasten side panels 504 and 506 to center panel 504 along the X-axis and/or the Z-axis, and multi-panel fastener 550 can fasten side panels 504 and 506 to center panel 504 along the X-axis and the Y-axis. Hence, multi-panel fastener 550 can assist securing panels 502, 504, and 506 to each other to form a rigid parabolic reflector, and can also include a mounting assembly 530 for mounting directional antenna 500 onto an external surface.

Figure 6A:
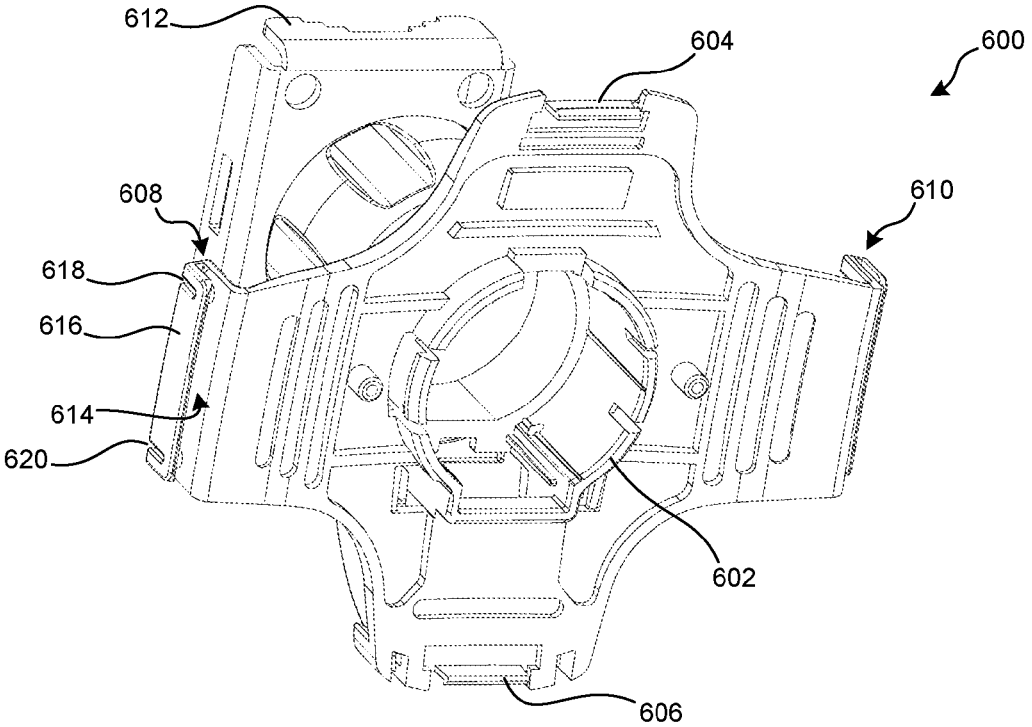
FIG. 6A illustrates a close-up view of a mounting assembly in accordance with an embodiment.

FIG. 6A illustrates a close-up view of a mounting assembly 600 in accordance with an embodiment. Specifically, mounting assembly 600 can include an antenna-feed fastener 602 for fastening an antenna feed to mounting assembly 600. A back side of the feed assembly may be inserted into antenna feed fastener 602, and a wedge-anchor fastener (not shown) can anchor against an opening on mounting assembly 600 (not shown).

Mounting assembly 600 can also include a set of center-panel fasteners 604 and 606, and a set of side-panel fasteners 608 and 610. Center-panel fasteners 604 and 606 may include a wedge-anchor fastener, which may fasten mounting assembly 600 to a center panel of a parabolic reflector. Side-panel fastener 608, for example, can include a sleeve 614 which may be defined by a curved surface 616, as well as a pair of stops 618 and 620. Curved surface 616 may wrap around the mated the curved edge segments of a side panel and center panel of the parabolic reflector, and stops 618 and 620 may prevent the side panel from moving along the Y-axis (e.g., the vertical axis).

Figure 6B:
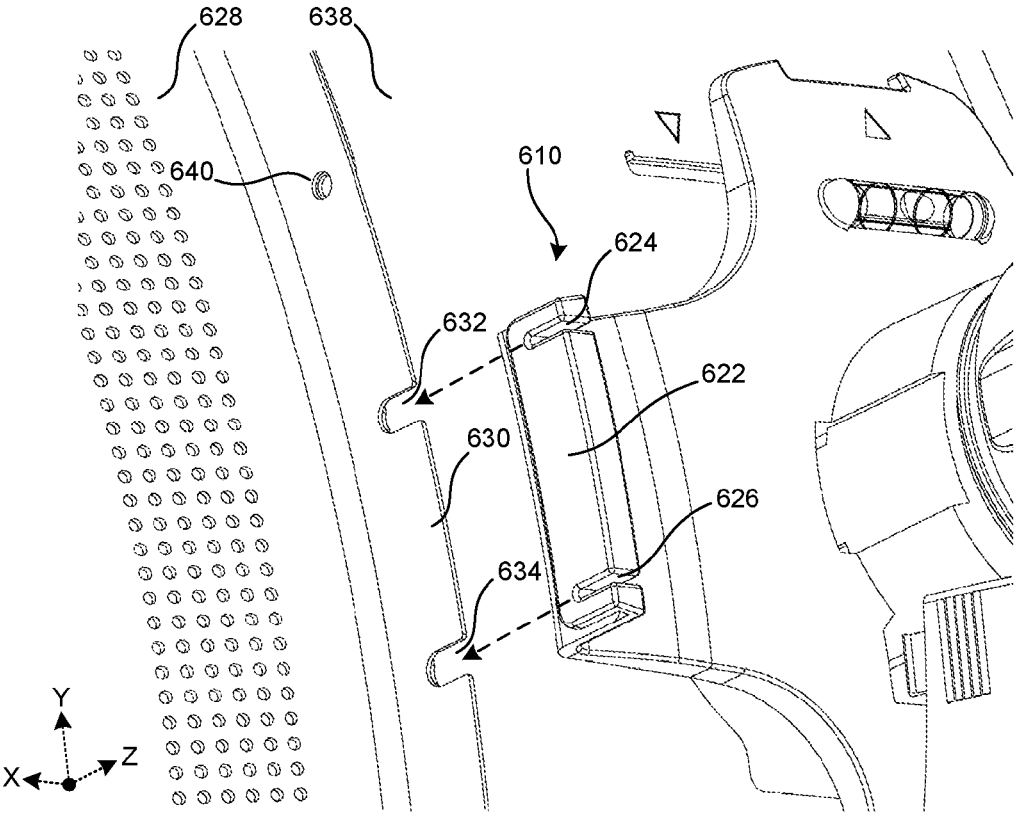
FIG. 6B illustrates the mounting assembly being coupled to a rear surface of a multi-panel directional antenna in accordance with an embodiment.

FIG. 6B illustrates the mounting assembly 600 being coupled to a rear surface of a multi-panel directional antenna in accordance with an embodiment. Specifically, a sleeve 622 of side-panel fastener 610 may slide over a curved-edge segment 630 of a side panel 628, and stops 624 and 626 may slide into a pair of recessed segments of side panel 628 that define curved-edge segment 630. Moreover, a screw (not shown) can optionally be inserted into a set of screw-holes 640 on the side edges of panels 628 and 638 to further secure panel 628 onto panel 638.

Figure 7A:
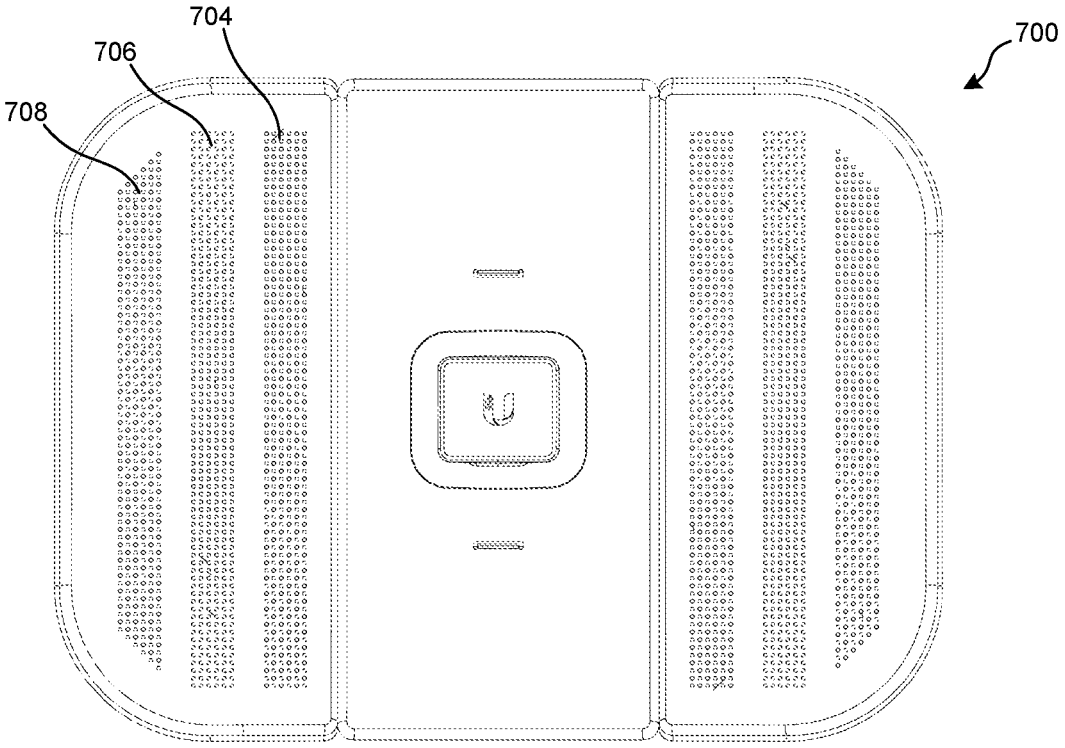
FIG. 7A illustrates a front view of an assembled multi-panel directional antenna in accordance with an embodiment.
Figure 7B:
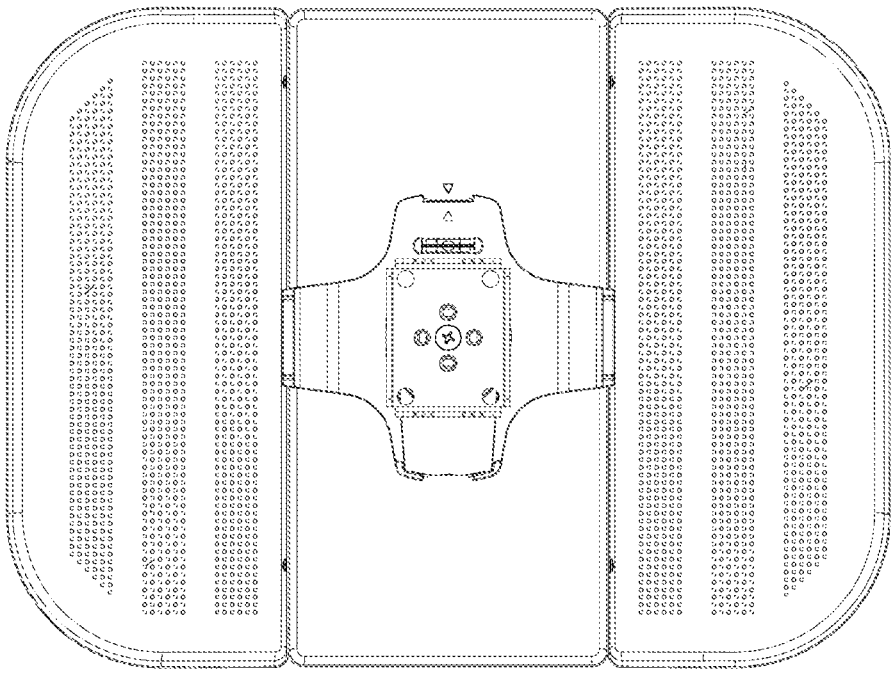
FIG. 7B illustrates a rear view of the assembled multi-panel directional antenna in accordance with an embodiment.

FIG. 7A illustrates a front view of an assembled multi-panel directional antenna, and FIG. 7B illustrates a rear view of the assembled multi-panel directional antenna in accordance with an embodiment. The side panels of directional antenna 700 can include perforated side panels. For example, side panel 704 can include a plurality of holes arranged in multiple columns that each span a Y-axis. In some embodiments, the columns may be equally spaced from each other along an X-axis. Alternatively, the columns may be organized into two or more groups of rows, where the spacing between two neighboring groups is larger than the spacing between two neighboring columns within a group. Moreover, the side panels can include rounded corners, and the perforated columns near the rounded corners may be shorter than other perforated columns away from the rounded corner. For example, the perforated columns in column group 708 may be shorter closer to an outer edge of side panel 704, whereas the perforated columns of a column group 706 may be of equal height.

Figure 7C:
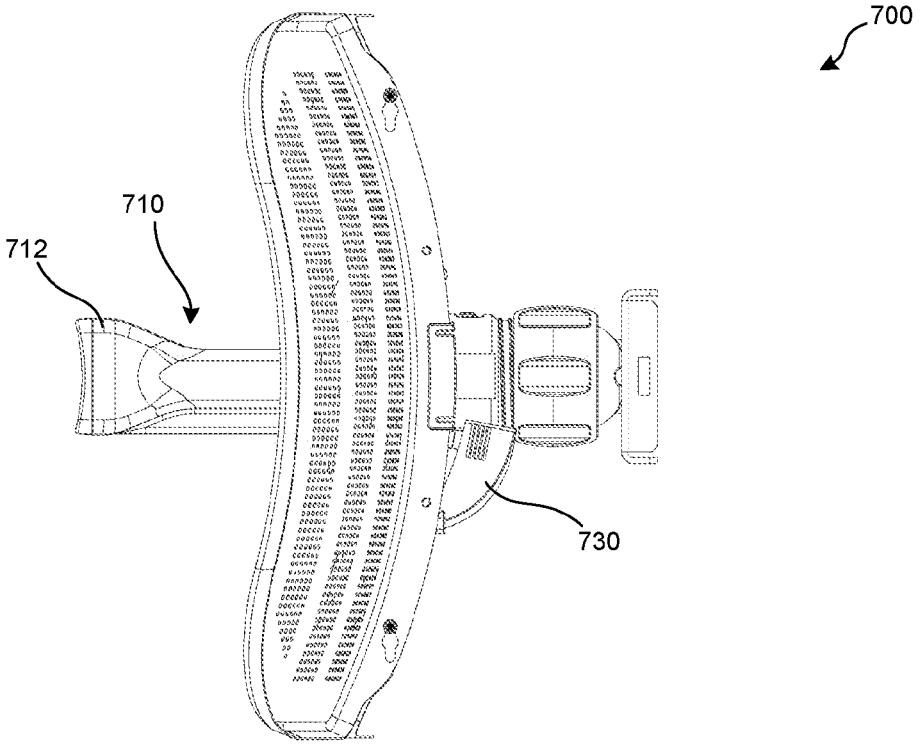
FIG. 7C illustrates a side view of an assembled multi-panel directional antenna in accordance with an embodiment.

FIG. 7C illustrates a side view of an assembled multi-panel directional antenna 700 in accordance with an embodiment. Specifically, directional antenna 700 can include a parabolic reflector 702 that can have a parabolic shape along a Y-axis. The parabolic shape can reflect radio waves toward a front end 712 of feed assembly 710.

Figure 7D:
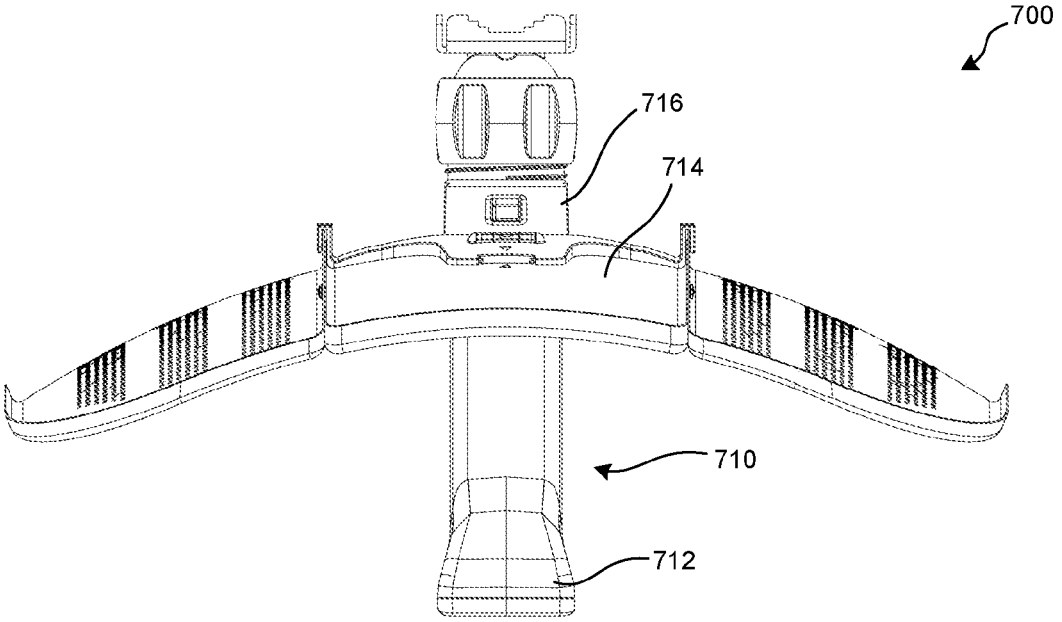
FIG. 7D illustrates a top view of an assembled multi-panel directional antenna in accordance with an embodiment.

FIG. 7D illustrates a top view of an assembled multi-panel directional antenna 700 in accordance with an embodiment. Specifically, parabolic reflector 702 can have a parabolic shape along a X-axis, such that the parabolic shape can reflect radio waves toward front end 712 of feed assembly 710.

Figure 7E:
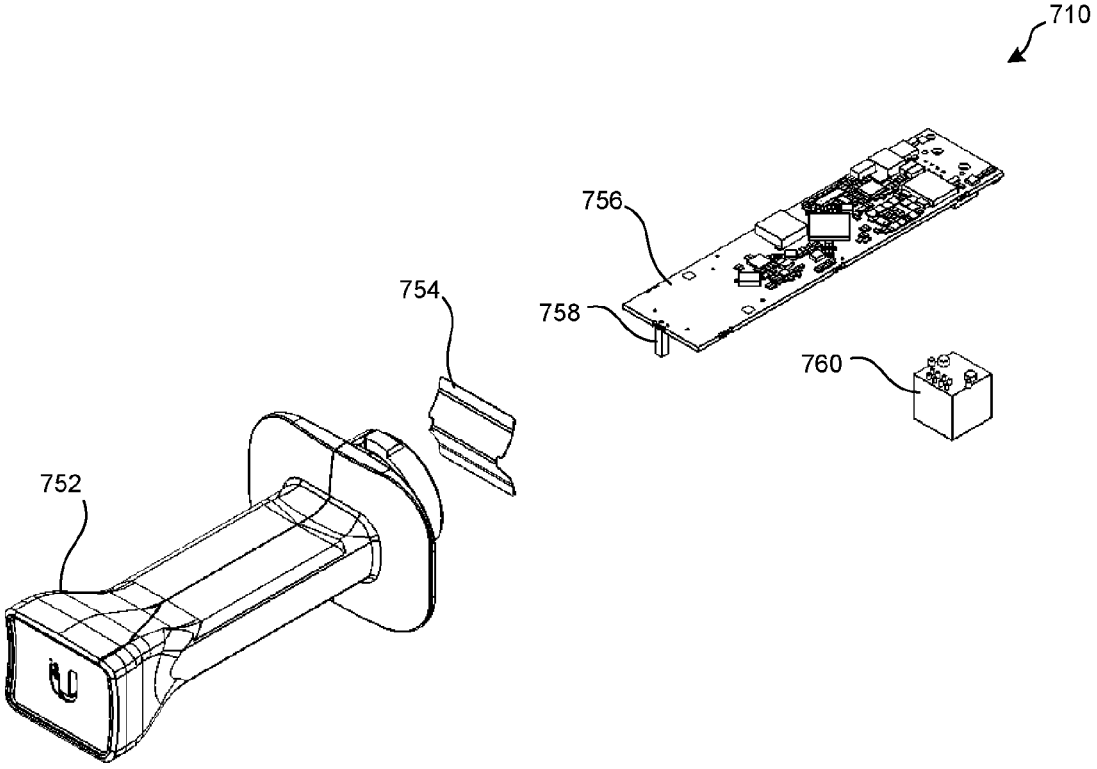
FIG. 7E illustrates an exploded view of the antenna feed assembly in accordance with an embodiment.

FIG. 7E illustrates an exploded view of antenna feed assembly 710 in accordance with an embodiment. Antenna feed assembly 710 can include a feed housing 752, which may house an antenna tube, a sub-reflector 754, a printed circuit board 756, a battery, a interfacing connector 760, a radio transceiver, a feed conductor, feed pins 758, and director pins. The housing can have a closed end and an open end. The open end may be surrounded by a base collar that may be adapted to lay against the surface surrounding a central aperture of a parabolic reflector. The housing may be constructed from materials that may protect the feed components from outdoor exposure, such as fairly rigid plastics.

The antenna tube may extend from inside the housing and may project past the open end of the housing. Similar to feed housing 752, the antenna tube may also have an open end and a closed end, and the dimensions of the antenna tube may be adjusted in accordance to the size of sub-reflector 754. An interfacing cable (not shown) may be routed through the tube and connected to the interfacing connector 760 (e.g., an Ethernet port). The exterior portion of the tube projecting outside of the housing may have a threaded portion for inserting into the aperture of the reflector and securing to the mounting assembly.

Sub-reflector 754 can have a shape that may radiate waves toward the main parabolic reflector, and may be situated in the dosed end portion of feed housing 752. The printed circuit board, having RF control circuitry, may receive power from the battery that may be connected to the circuit board, or may receive power from the interfacing cable (e.g., a Power-over-Ethernet cable). The circuit board may serve as the platform for the interfacing connector, radio transceiver, feed conductor, feed pins, and director pins.

In application, interfacing connector 760 may be coupled to the radio transceiver for power and data input and output purposes, when configured with a digital cable. The radio transceiver may generate an RF signal that can be coupled to the feed conductor, which in turn, can be coupled to the feed pins. Feed pins 758 may radiate the RF signal to sub-reflector 754, which then may radiates the RF signal to the parabolic reflector (e.g., reflector 714). The director pins, which may be passive radiators or parasitic elements, may help focus or reradiate waves to feed pins 758 in order maximize the waves radiated from sub-reflector 754 to the parabolic reflector.

Figure 7G:
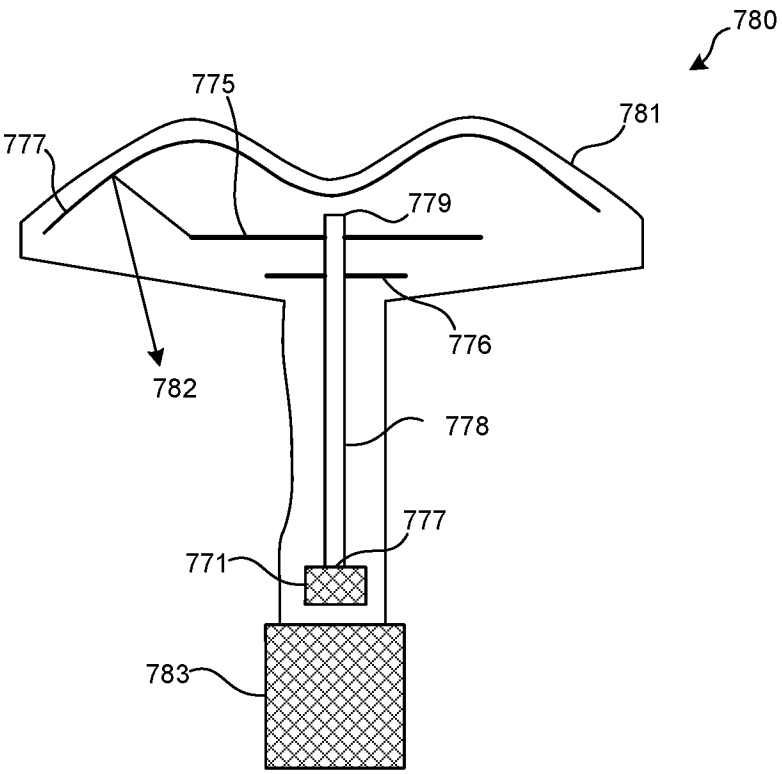
FIG. 7G illustrates another example of an integrated radio transceiver and feed comprising a housing with an antenna tube in accordance with an embodiment.
Figure 7F:
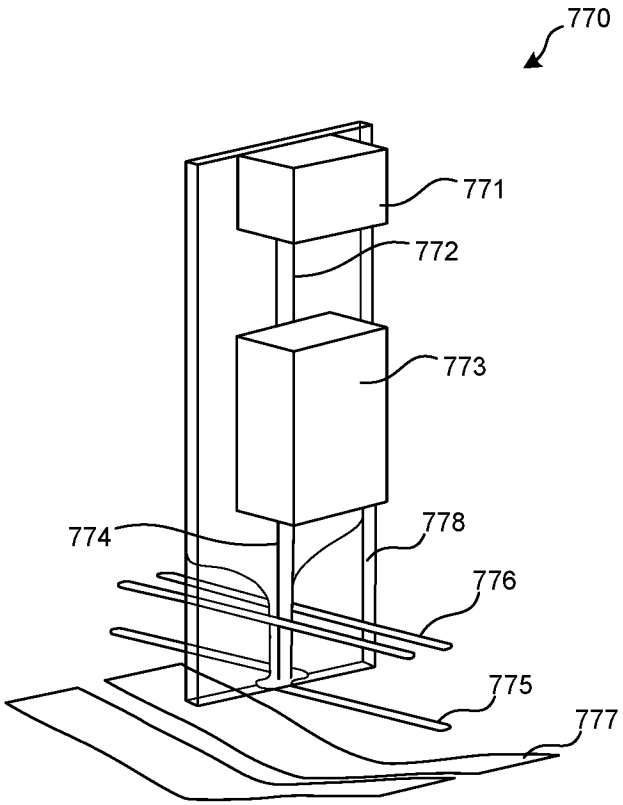
FIG. 7F illustrates an exemplary integrated radio transceiver and feed in accordance with an embodiment.

FIG. 7F illustrates an exemplary integrated radio transceiver and feed 770 in accordance with an embodiment. As illustrated, radio transceiver and feed 770 can integrate the functions of a radio transceiver, the functions of an antenna feed conductor, and the functions of a conventional antenna feed mechanism. Integrated radio transceiver and feed 770 may be located in antenna feed mechanism 710. Integrated radio transceiver and feed 770 may be assembled on a common substrate, which may be a multi-layer printed circuit board (PCB) 778.

Integrated radio transceiver and feed 770 can include a digital connector 771, which may be an Ethernet connector, a USB connector, or any other digital connector now known or later developed. A digital signal from a client station may be transmitted to, or received from, the digital connector 771 over a digital cable. To power the radio transceiver in integrated radio transceiver and feed 770, the digital cable may include a power component. The power component may be provided over an Ethernet cable, a USB cable, or other equivalent digital cable.

In some embodiments, digital connector 771 may be coupled to a radio transceiver 773 via conductor 772. Conductor 772 may be implemented by a metal by a metal connector on a PCB 778. Radio transceiver 773 may be coupled to an antenna feed conductor 774, which in turn couples to antenna feed pins 775. Radio transceiver 773 can generate an RF signal that radiate from antenna feed pins 775 radiate toward an antenna reflector, such as toward a parabolic reflector panel, or sub-reflectors 777. In some embodiments, the radiated signal may be modified and enhanced by director pins 776 and/or sub-reflectors 777.

As illustrated in FIG. 7F, antenna feed pins 775 can include two pins that may be located on opposite sides of PCB 778, and the pins may be electrically connected together. In some embodiments, an antenna feed pin 775 may implement a half wave-length dipole. However, the inclusion of director pins 776 and sub-reflectors 777 may modify away from that of a half-wave length dipole.

In some embodiments, director pins 776 may operate as passive radiators or parasitic elements. For example, director pins 776 may not have a wired input. Rather, director pins 776 may absorb radio waves that have radiated from another active antenna element in proximity, such as feed pins 775, and may re-radiate the radio waves in phase with the active element so that director pins 776 may augments the total transmitted signal. An example of an antenna that uses passive radiators is the Yagi, which typically has a reflector behind the driven element, and one or more directors in front of the driven element, which may act respectively like a reflector and lenses in a flashlight to create a "beam." Hence, parasitic elements may be used to alter the radiation parameters of nearby active elements.

In some embodiments, director pins 776 may be electrically isolated in integrated radio transceiver and feed 770. Alternatively, director pins 776 may be grounded. For example, director pins 776 can include two pins that may be inserted through PCB 208, such that two pins may remain at each side of PCB 208, as illustrated in FIG. 7F. Antenna feed pins 775 and director pins 776 may be mounted perpendicular to a surface of PCB 778. Moreover, antenna feed pins 775 and/or director pins 776 may be implemented with surface mounted (SMT) pins.

The perpendicular arrangement of antenna feed pins 775 and director pins 776 may allow the transmission of radio waves to be planar to the integrated radio transceiver and feed 770. In this arrangement, the electric field may be tangential to the metal of PCB 778, such that at the metal surface, the electric field may be zero. Thus, the radiation from the perpendicular pins can have a minimal impact upon the other electronic circuitry on PCB 778. Hence, antenna feed pins 775 and director pins 776 may emit approximately equal F and H plane radiation patterns that can provide for effective illumination of the antenna, thus increasing the microwave system efficiency.

FIG. 7G illustrates another example of an integrated radio transceiver and feed 780 comprising a housing 781 with an antenna tube 783 in accordance with an embodiment. Housing 781 may be a weather-proof housing, such as a plastic housing that may enclose the elements of integrated radio transceiver and feed 780. Housing 781 may conform to the shape of sub-reflector 777. In some embodiments, housing 781 may permit interchangeability of the sub-reflector 777.

As illustrated in FIG. 7G, sub-reflector 777 located near a distal end 779 of PCB 778 may reflect radiated waves 782 back toward a reflective antenna (e.g., a parabolic antenna reflector panel). The radiation pattern and parameters may be modified by sub-reflector antenna 777, which may be located near antenna feed pins 775. Director pins 776 and/or sub-reflector 777 can be selected to modify the antenna pattern and beam width, such as to improve the microwave system performance.

In some embodiments, tube 783 may also be adjusted to various lengths in order to accommodate reflectors of different sizes. A digital cable may be routed through tube 783, and can connect to digital connector 771 located near a proximal end 777 of PCB 778. Digital connector 771 may have a weatherized connector, such as a weatherized Ethernet or USB connector.

A description of an integrated radio transceiver and feed is described in U.S. Pat. No. 8,466,847 (entitled "MICROWAVE SYSTEM," by inventors Robert J. Pera and John R. Sanford, filed 4 Jun. 2009), which is hereby incorporated by reference herein in its entirety.

Two-Panel Directional Antenna

Figure 8A:
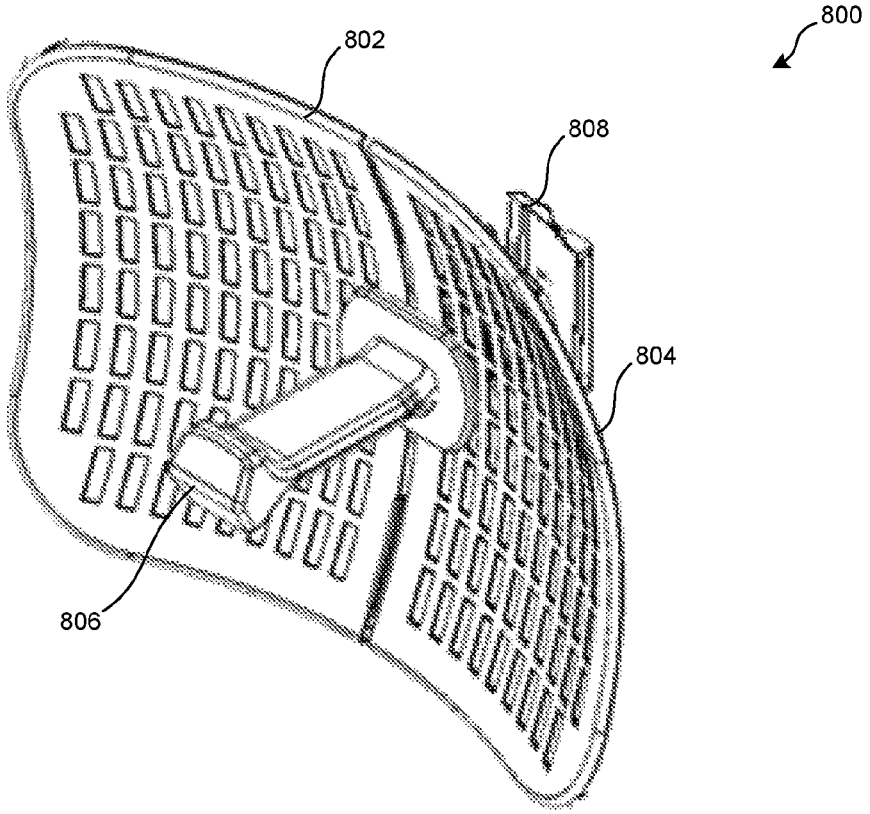
FIG. 8A illustrates an exemplary two-panel directional antenna in accordance with an embodiment.

FIG. 8A illustrates an exemplary two-panel directional antenna 800 in accordance with an embodiment. Directional antenna 800 can include two panels 802 and 804 that together form a parabolic reflector. Moreover, a mounting assembly 808 can be coupled to a rear (convex) side of the parabolic reflector, and a feed assembly 806 can be coupled to a front (concave) side of the parabolic reflector.

Figure 8B:
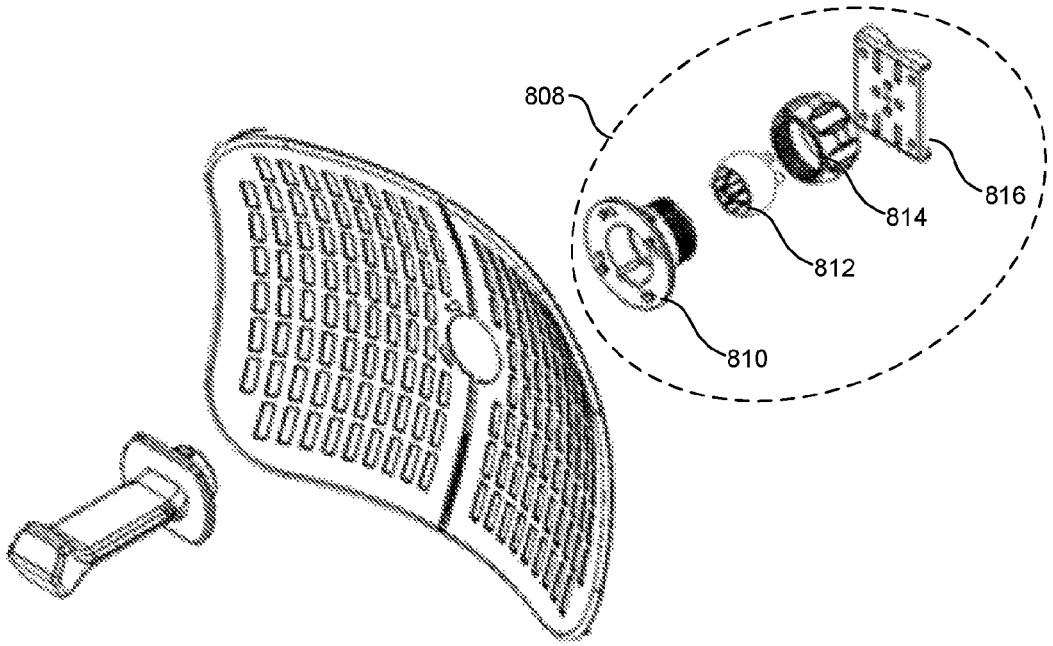
FIG. 8B illustrates an exploded view of a mounting assembly in accordance with an embodiment.

FIG. 8B illustrates an exploded view of mounting assembly 808 in accordance with an embodiment. Specifically, mounting assembly 808 can include a multi-panel fastener 810, with a proximal end that can include a flat surface with two or more openings for fastening multi-panel fastener 810 to a rear surface of side panels 802 and 804. The distal end of multi-panel fastener 810 can include a threaded circular outer surface for screwing a lock nut 814 to multi-panel fastener 810. Lock nut 814 and the distal end of multi-panel fastener 810 can each include an orifice for securing a ball joint 812 between multi-panel fastener 810 and lock nut 814.

Ball joint 812 can include a set of prongs which can be coupled to a mounting base 816.

Figure 8C:
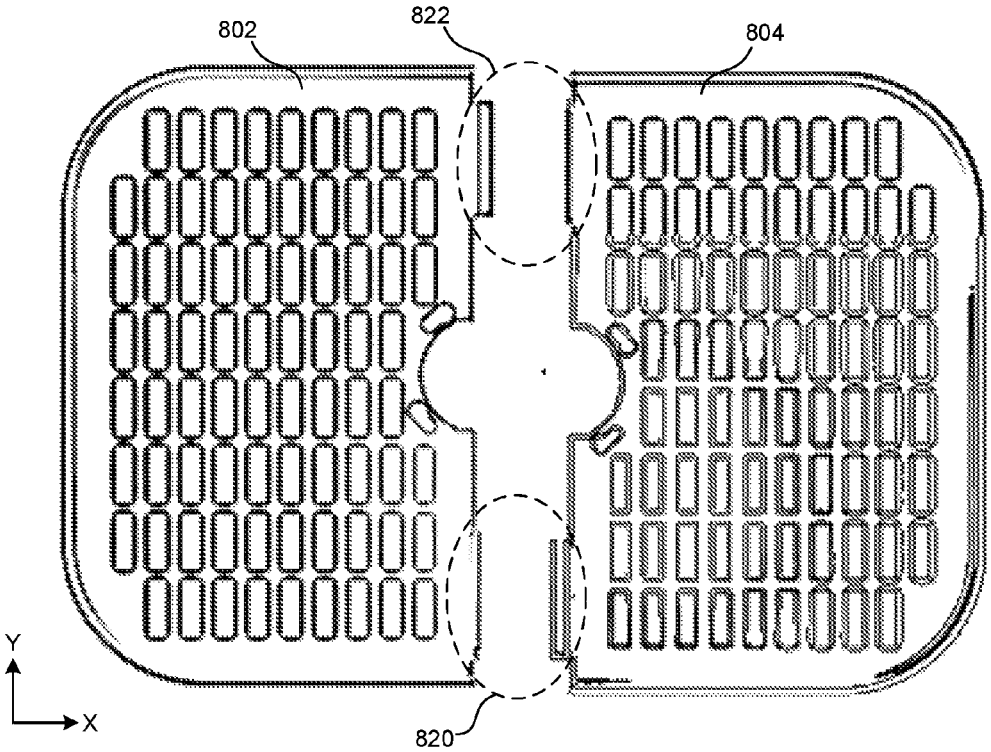
FIG. 8C illustrates two panels of the directional antenna in accordance with an embodiment.

FIG. 8C illustrates two panels 802 and 804 of the directional antenna in accordance with an embodiment. Specifically, panels 802 and 804 can include a set of couplings, which can fasten panels 802 and 804 together. In some embodiments, couplings 820 and 822 can each include a bore and sleeve coupling. For example, panel 804 can include bores along an inside edge (e.g., for couplings 820 and 822), and panel 802 can include sleeves along an inside edge. As another example, panel 802 can include a bore for one coupling and a sleeve for another coupling, and panel 804 can include the corresponding bore and sleeve for coupling panel 804 to panel 802.

In some embodiments, a bore may snap-fit into a receiving sleeve. When the inside edge of panels 802 and 804 are vertically aligned along the Y-axis, the sleeve on an inside edge of one panel may be positioned to couple with a bore on the inside edge of the other panel. For example, coupling the bores to their corresponding sleeves may involve moving at least one panel along the Z-axis, to insert the bores into the corresponding sleeves.

Alternatively, a bore may be slid into a sleeve. For example, panels 802 and 804 may first be aligned along the X-axis and Z-axis, and one panel may then be moved along the Y-axis to slide the bores into the sleeves.

In embodiments, the inner edge of panels 802 and 804 may have a semi-circularly shaped cutout along the middle section of the edge. When the inner edges of the panels are placed next to each other and vertically aligned, the cutouts form the reflector's central aperture for receiving the antenna feed assembly.

While the description above describes using bore-and-sleeve couplings for a two-panel antenna, different locking mechanisms may be suitably used to connect multiple panels to form a reflector. For example, two or more panels may be coupled using a combination of one or more of an elbow lock seam; a z-clip fastener, a retention clip, a standing seam attachment bracket, and/or any other fastener now known or later developed. Furthermore, various interconnects may also be used to secure the panels together, such as a bolt, a screw, a pronged rivet, and a tension pin.

Figure 8D:
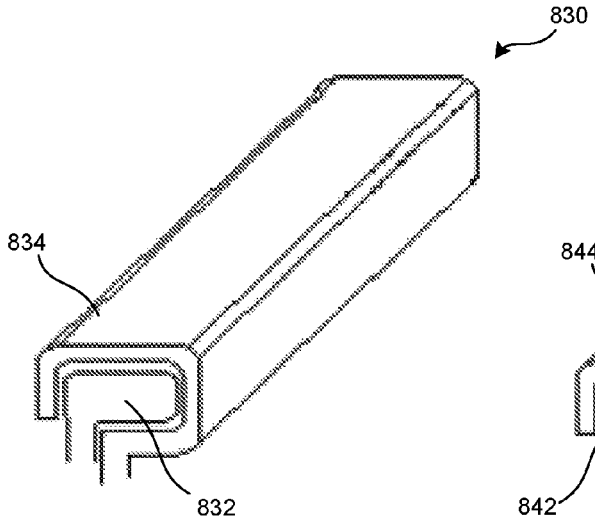
FIG. 8D illustrates an exemplary bore-and-sleeve coupling in accordance with an embodiment.

FIG. 8D illustrates an exemplary bore-and-sleeve coupling 830 in accordance with an embodiment. Coupling 830 can include a bore 832, which can slide into a sleeve 834 along a Z-axis from either end of sleeve 834. Sleeve 834 can surround a portion of bore 832 along a Z-axis, which may secure bore 832 along an X-axis and Y-axis.

Figure 8E:
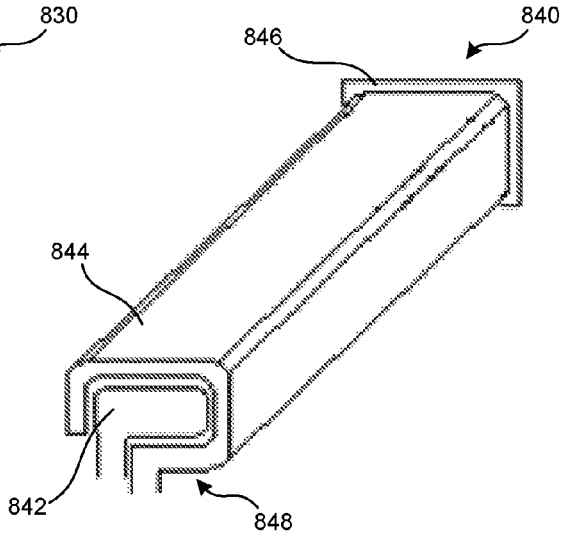
FIG. 8E illustrates an exemplary bore-and-sleeve coupling with a stopper in accordance with an embodiment.

FIG. 8E illustrates an exemplary bore-and-sleeve coupling 840 with a stopper 846 in accordance with an embodiment. Specifically, coupling 840 can include a sleeve 844, which itself can include an opening 848 at one end, and a stopper 846 at an opposing end. A bore 842 can be slid into opening 848, until one end of bore 842 makes contact with stopper 846.

Figure 8F:
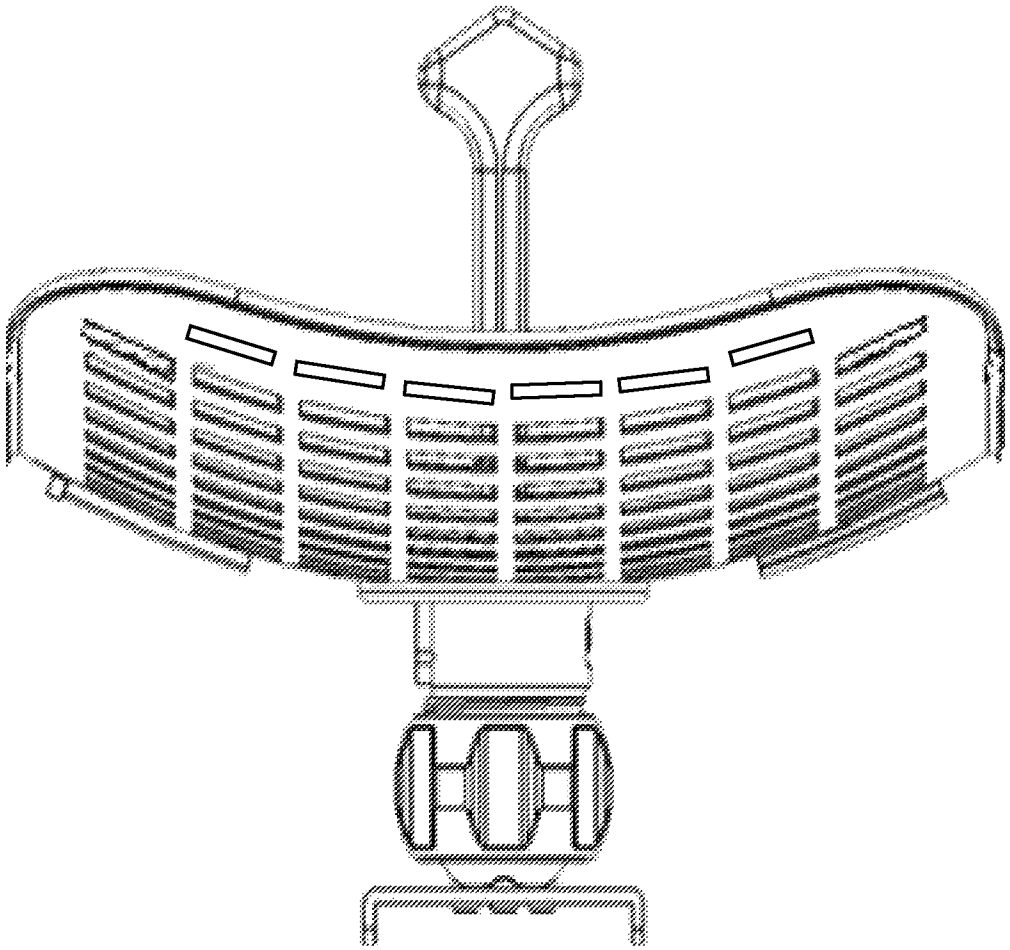
FIG. 8F illustrates an assembled two-panel directional antenna in accordance with an embodiment.
Figure 8G:
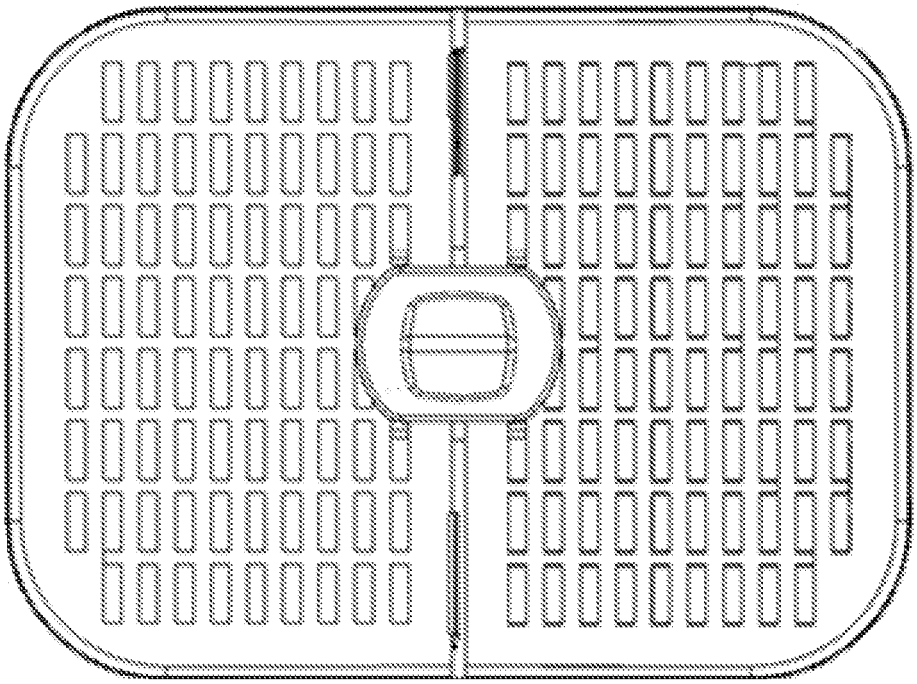
FIG. 8G illustrates a front view of the assembled two-panel directional antenna in accordance with an embodiment.
Figure 8H:
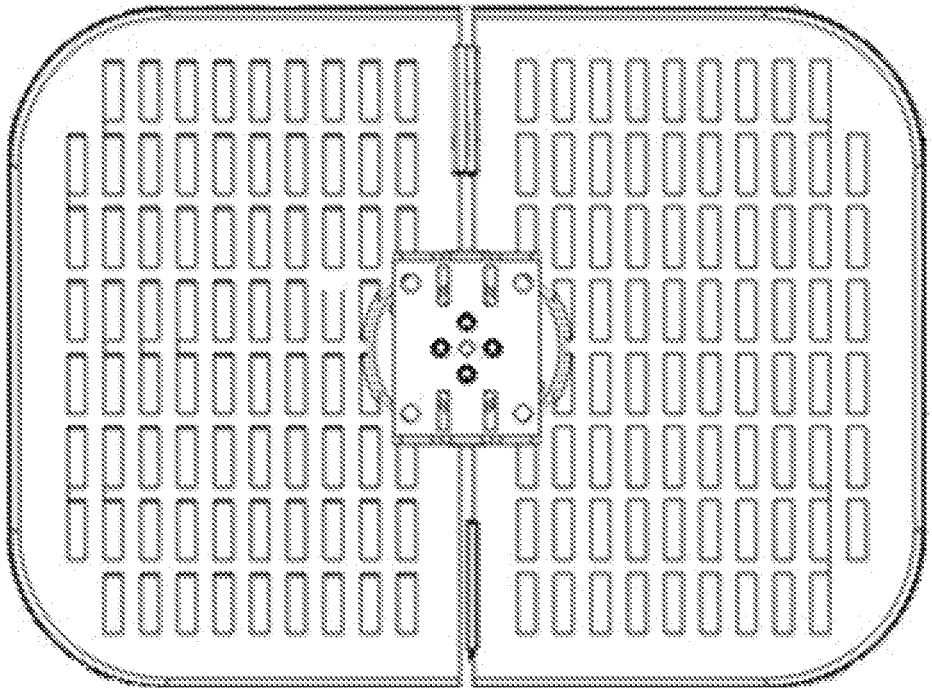
FIG. 8H illustrates a back view of the assembled two-panel directional antenna in accordance with an embodiment.

FIG. 8F illustrates an assembled two-panel directional antenna 800 in accordance with an embodiment. Moreover, FIG. 8G illustrates a front view of the assembled two-panel directional antenna 800, and FIG. 8H illustrates a back view of the assembled two-panel directional antenna 800 in accordance with an embodiment.

Figure 8I:
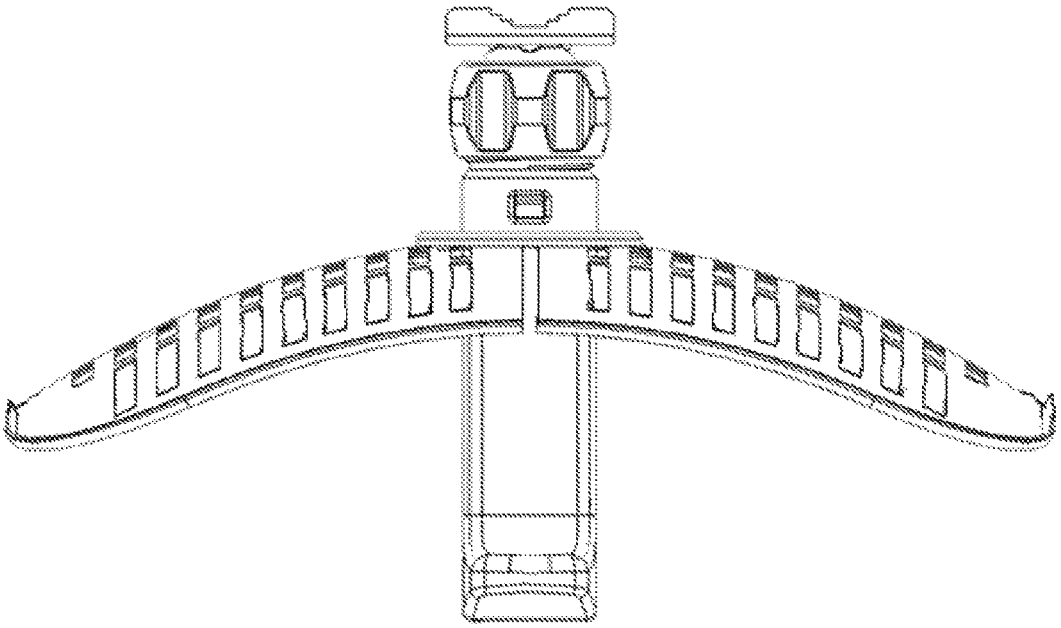
FIG. 8I illustrates a top view of the assembled two-panel directional antenna in accordance with an embodiment.
Figure 8J:
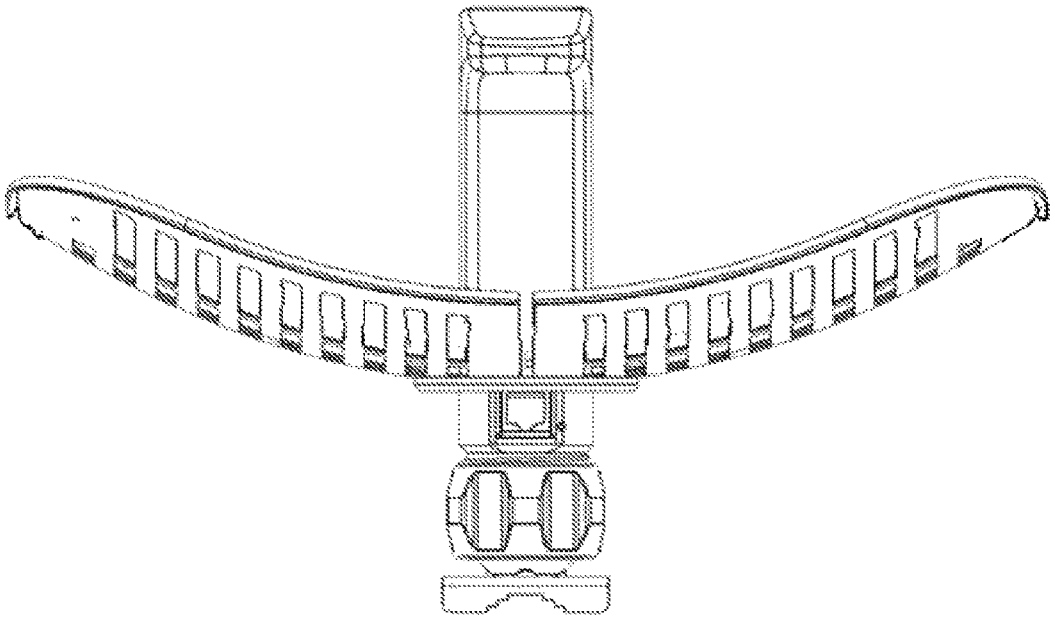
FIG. 8J illustrates a bottom view of the assembled two-panel directional antenna in accordance with an embodiment.

FIG. 8I illustrates a top view of the assembled two-panel directional antenna 800, and FIG. 8J illustrates a bottom view of the assembled two-panel directional antenna 800 in accordance with an embodiment.

Alternative Three-Panel Directional Antenna

Figure 9A:
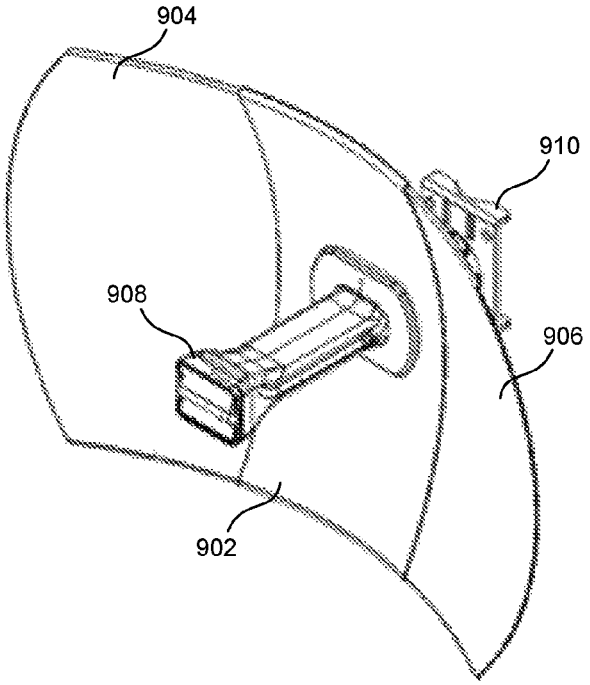
FIG. 9A illustrates an exemplary three-panel directional antenna in accordance with an embodiment.

FIG. 9A illustrates an exemplary three-panel directional antenna in accordance with an embodiment. The antenna system can include a reflector that may be formed from three panels 902, 904, and 906. In some embodiments, panels 902, 904, and 906, and/or an antenna feed assembly 908 may be attached to, and fastened against, a mounting assembly 910. Moreover, panels 904 and 906 may be fastened against center panel 902, and/or may also be fastened to each other.

Figure 9B:
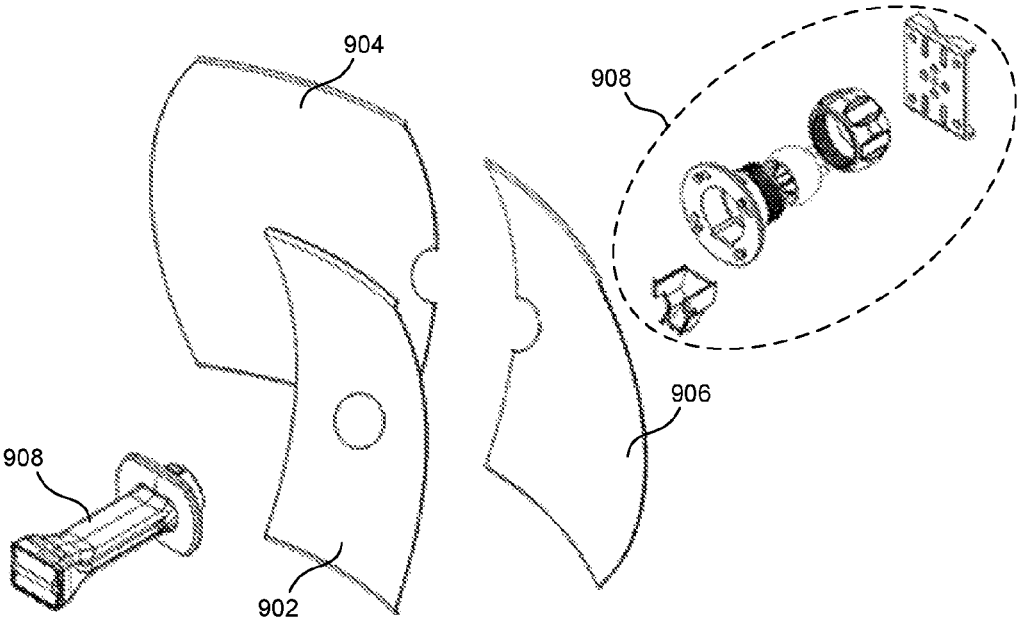
FIG. 9B illustrates an exploded view of the three-panel directional antenna in accordance with an embodiment.

FIG. 9B illustrates an exploded view of the three-panel directional antenna in accordance with an embodiment. In some embodiments, panels 902, 904, and 906 may be arranged in an overlapping formation to increase the structural rigidity of the reflector. For example, center panel 802 may include a central opening for coupling feed assembly 908 to mounting assembly 910. Also, side panels 804 and 806 may be essentially mirror images of each other, and each may have a substantially semi-circular cutout extending from an inner edge. When side panels 904 and 906 are aligned vertically with their inner edges touching one another, the cutouts may form the shape of the central opening on center panel 902 for receiving antenna feed assembly 908. When the reflector is assembled, central panel 902 may overlap a portion of side panels 904 and 906.

In some embodiments, panels 902, 904, and 906 may include a sliding track system to connect and hold panels 902, 904, and 906 in a configuration that forms the parabolic reflector. For example, on the convex side of center panel 902, a track may be positioned along one or both of the top and bottom edges. On the concave side of side panels 904 and 906, a carriage may lie along one or both of the top and bottom edges. A track on center panel 902 may allow a carriage on side panels 904 and 906 to slide die panels 904 and 906 into place, until the central opening of center panel 902 is aligned with the central opening formed by side panels 904 and 906. A stopper may be provided along the tracks to limit movement of the carriages once they have slid side panels 904 and 906 to their target locations. Moreover, the panels of the parabolic reflector are further strengthened and stabilized when antenna feed assembly 908 is inserted into the central opening of the reflector, and antenna feed assembly 908 is connected to the base of mounting assembly 910.

Figure 9C:
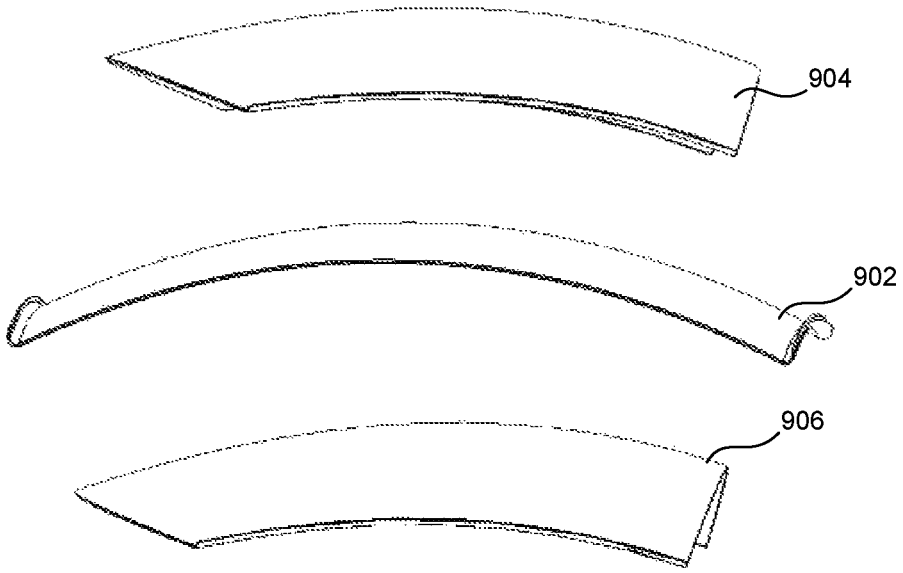
FIG. 9C illustrates a packaging configuration for the disassembled three-panel directional antenna in accordance with an embodiment.

FIG. 9C illustrates a packaging configuration for the disassembled three-panel directional antenna in accordance with an embodiment. Specifically, panels 902, 904, and 906 may be packaged into a container in a stacked configuration, such that center panel 902 may be sandwiched between side panels 904 and 906. Alternatively, center panel 902 may be stacked above side panels 904 and 906, or may be stacked underneath side panels 904 and 906. In some variations, panels 902, 904, and 906 may be stacked vertically within a container, with their concave surfaces facing toward a top surface or a bottom surface of the container. Alternatively, the stacked panels may be placed in the container so that panels 902, 904, and 906 may be stacked horizontally, with their concave surfaces facing toward a side surface of the container.

Figure 9D:
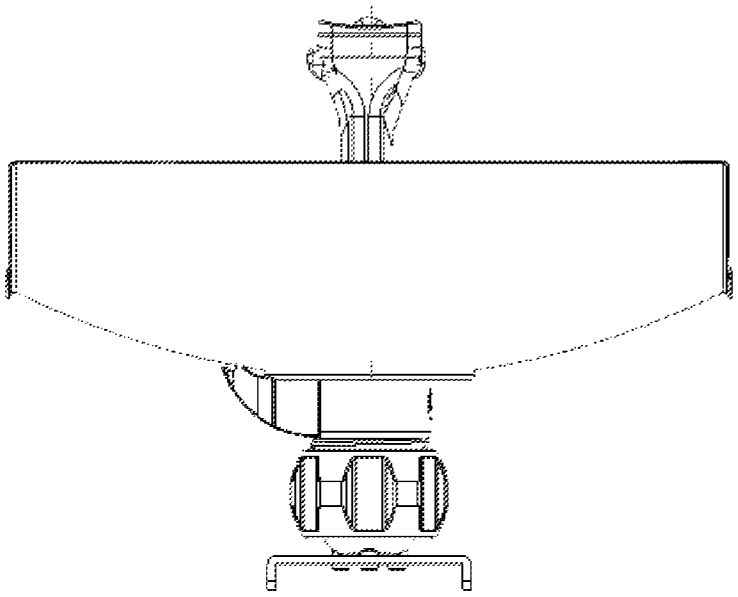
FIG. 9D illustrates a side view of the assembled three-panel directional antenna in accordance with an embodiment.

FIG. 9D illustrates a side view of the assembled three-panel directional antenna in accordance with an embodiment.

Figure 9E:
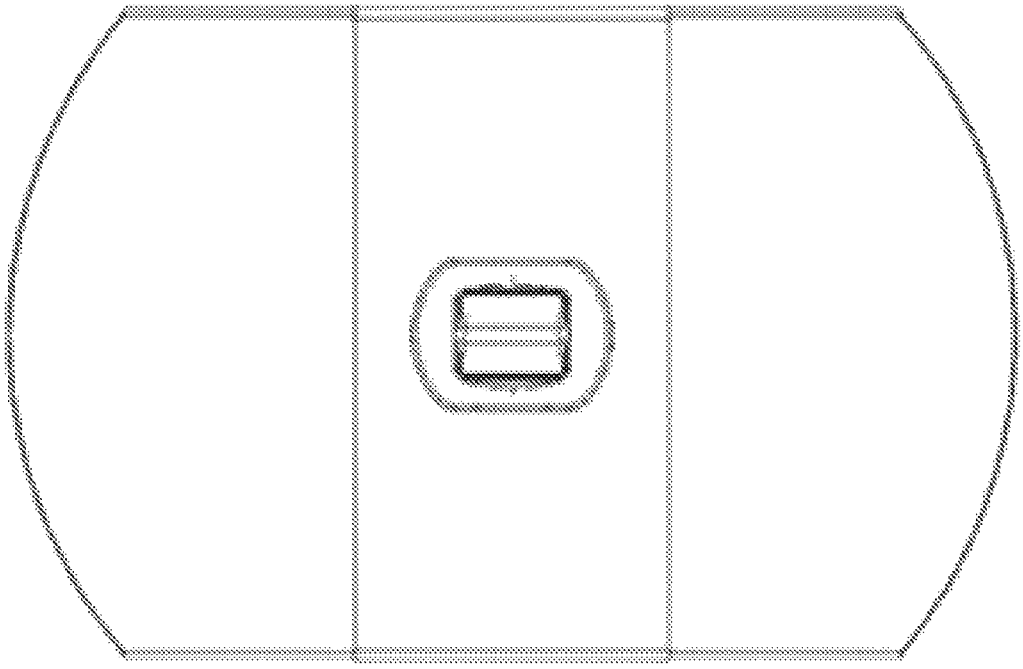
FIG. 9E illustrates a front view of the assembled three-panel directional antenna in accordance with an embodiment.
Figure 9F:
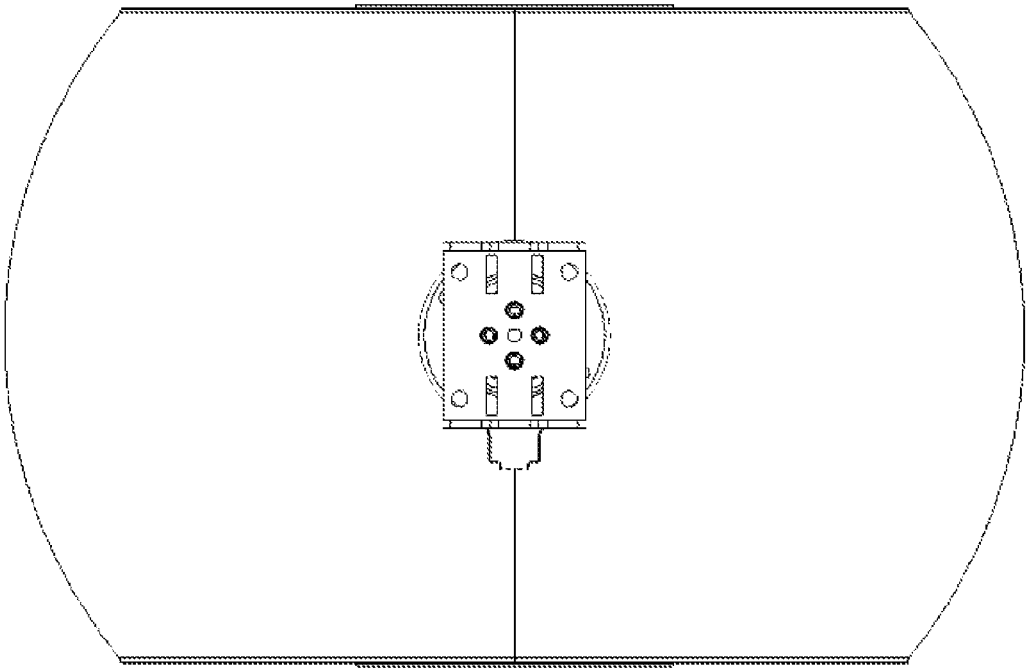
FIG. 9F illustrates a back view of the assembled three-panel directional antenna in accordance with an embodiment.
Figure 9G:
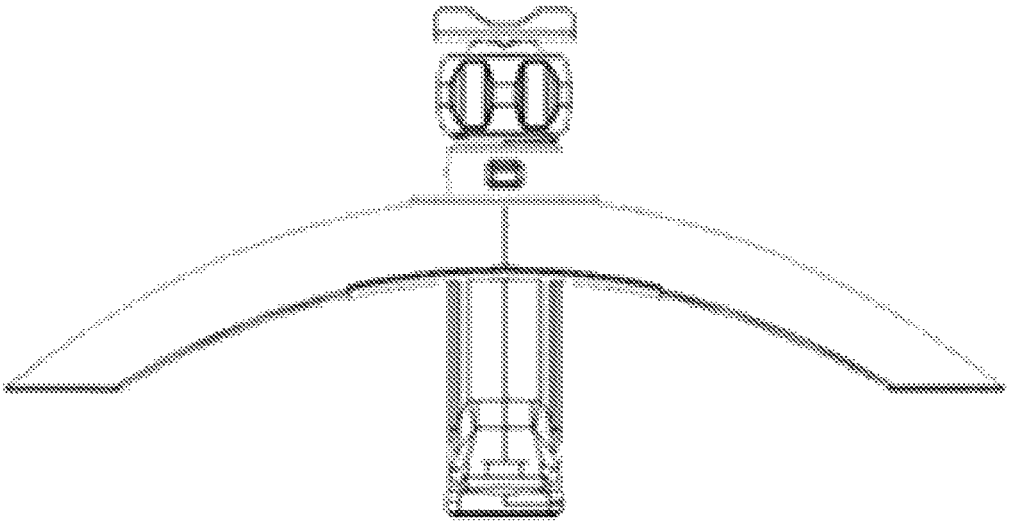
FIG. 9G illustrates a top view of the assembled three-panel directional antenna in accordance with an embodiment.
Figure 9H:
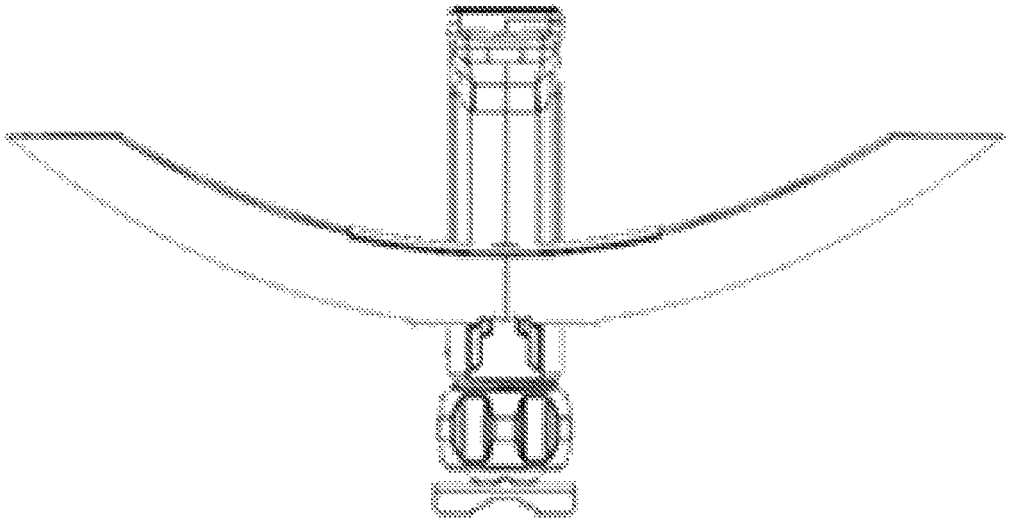
FIG. 9H illustrates a bottom view of the assembled three-panel directional antenna in accordance with an embodiment.

FIG. 9E illustrates a front view of the assembled three-panel directional antenna, and FIG. 9F illustrates a back view of the assembled three-panel directional antenna in accordance with an embodiment. Moreover, FIG. 9G illustrates a top view of the assembled three-panel directional antenna, and FIG. 9H illustrates a bottom view of the assembled three-panel directional antenna in accordance with an embodiment.

The foregoing descriptions of embodiments of the present invention have been presented for purposes of illustration and description only. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. An antenna system, comprising:

a center reflector panel and two or more side reflector panels, wherein a respective reflector panel includes a curved surface that forms a portion of a parabolic reflector;

a multi-panel fastener operable to be fastened to a convex side of the center and side reflector panels that form the parabolic reflector, wherein the multi-panel fastener prevents the center and side reflector panels from becoming unfastened;

a feed assembly operable to be mounted on the concave side of the parabolic reflector, wherein a proximal end of the feed assembly is operable to pass through an opening on the center reflector panel and engage the multi-panel fastener to secure the multi-panel fastener to a convex side of the parabolic reflector, and wherein engaging the proximal end of the feed assembly to the multi-panel fastener secures the side reflector panels to prevent the side reflector panels from detaching from the center reflector panel;

a circuit board positioned inside the feed assembly and through the opening;

a network connector positioned near a proximal end of the circuit board, wherein the proximal end of the circuit board is located on the convex side of the center reflector panel;

a radiator positioned near a distal end of the circuit board, wherein the radiator is operable to emit radio waves that carry a digital signal received via the network connector, and wherein the distal end of the circuit board is located on the concave side of the center reflector panel; and a sub-reflector located in the feed assembly and near a distal end of the circuit board.

2. The antenna system of claim 1, wherein a respective reflector panel includes an inter-panel fastener operable to align a side surface of the respective reflector panel with a side surface of another reflector panel along a first axis; and wherein the multi-panel fastener fastens the respective reflector panel to the other reflector panel along at least a second axis orthogonal to the first axis.

3. The antenna system of claim 2, wherein the multi-panel fastener fastens the respective reflector panel to the other reflector panel along at least a second axis orthogonal to the first axis.

4. The antenna system of claim 1, wherein the circuit board includes a radio and is positioned inside a cavity of the feed assembly, and wherein the network connector serves as a data port for the radio.

5. The antenna system of claim 4, wherein the data port provides a digital data interface for the radio, and wherein when the feed assembly is mounted on the concave side of the parabolic reflector, the data port is accessible from the convex side of the parabolic reflector.

6. The antenna system of claim 1, wherein the opening of the center reflector panel exposes a mounting assembly at the concave side of the parabolic reflector.

7. The antenna system of claim 6, wherein mounting the feed assembly on the concave side of the parabolic reflector involves:

passing the proximal end of the feed assembly through the opening; and coupling the proximal end of the feed assembly to the mounting assembly.

8. The antenna system of claim 7, wherein coupling the proximal end of the feed assembly to the mounting assembly on the multi-panel fastener fastens the feed assembly to the concave side of the parabolic reflector, and fastens the multi-panel fastener to the convex side of the parabolic reflector.

9. The antenna system of claim 1, wherein the feed assembly includes a release button for releasing the feed assembly from the multi-panel fastener.

10. The antenna system of claim 1, wherein the multi-panel fastener includes a wedge-anchor fastener for coupling the multi-panel fastener to a convex side of the center panel.

11. The antenna system of claim 1, wherein the center reflector panel is operable to be coupled to a side reflector panel at each of two opposing side surfaces of the center reflector panel.

12. The antenna system of claim 11, further comprising a mounting assembly operable to fasten the multi-panel fastener to a surface external to the antenna system.

13. The antenna system of claim 12, wherein the mounting assembly includes a convex portion of a ball joint operable to be coupled to the multi-panel fastener, wherein the multi-panel fastener includes a concave portion of the ball joint for receiving the convex portion of the ball joint, and wherein coupling the convex portion to the concave portion facilitates adjusting an altitude and azimuth of the parabolic reflector's direction.

14. An antenna system, comprising:

a first side reflector panel, comprising a curved surface that forms a portion of a parabolic reflector;

a second side reflector panel comprising a curved surface that forms another portion of the parabolic reflector;

a center reflector panel comprising a curved surface that forms a center portion of the parabolic reflector, wherein the center reflector panel includes a set of inter-panel fasteners operable to align a side surface of the center reflector panel with a corresponding side surface of a respective side reflector panel;

a multi-panel fastener operable to secure the first side reflector panel and the second side reflector panel to the center reflector panel;

a feed assembly operable to be attached to the multi-panel fastener; wherein a proximal end of the feed assembly is operable to pass through an opening on the center reflector panel, and engage the multi-panel fastener to secure the multi-panel fastener to a convex side of the parabolic reflector, and wherein engaging the proximal end of the feed assembly to the multi-panel fastener secures the side reflector panels to prevent the side reflector panels from detaching from the center reflector panel;

a circuit board positioned inside the feed assembly and through the opening;

a network connector positioned near a proximal end of the circuit board, wherein the proximal end of the circuit board is located on the convex side of the center reflector panel;

a radiator positioned near a distal end of the circuit board, wherein the radiator is operable to emit radio waves that carry a digital signal received via the network connector, and wherein the distal end of the circuit board is located on the concave side of the center reflector panel; and a sub-reflector located in the feed assembly and near a distal end of the circuit board.

15. The antenna system of claim 14, wherein the inter-panel fastener of the respective reflector panel fastens the respective reflector panel to the other reflector panel along a first axis; and wherein the multi-panel fastener fastens the respective reflector panel to the other reflector panel along at least a second axis orthogonal to the first axis.

16. The antenna system of claim 14, wherein the circuit board includes a radio and is positioned inside a feed tube, and wherein the network connector is coupled to the radio.

17. The antenna system of claim 14, further comprising a mounting assembly operable to fasten the multi-panel fastener to a surface external to the antenna system, wherein the mounting assembly includes a convex portion of a ball joint operable to be coupled to the multi-panel fastener, wherein the multi-panel fastener includes a concave portion of the ball joint for receiving the convex portion of the ball joint, and wherein coupling the convex portion to the concave portion facilitates configuring an altitude and azimuth of the parabolic reflector's direction.

18. An antenna system, comprising:

a center reflector panel and two or more side reflector panels, wherein a respective reflector panel includes a curved surface that forms a portion of a parabolic reflector, and includes an inter-panel coupler that aligns a side surface of the respective reflector panel with a side surface of another reflector panel;

a multi-panel coupler, coupled to a convex side of the center and side reflector panels that form the parabolic reflector, wherein the multi-panel coupler prevents a respective inter-panel coupler of the center and side reflector panels from becoming unfastened;

a feed assembly mounted on the concave side of the parabolic reflector, wherein a proximal end of the feed assembly is operable to pass through an opening on the center reflector panel, and engage the multi-panel coupler to secure the multi-panel coupler to a convex side of the parabolic reflector, and wherein engaging the proximal end of the feed assembly to the multi-panel coupler secures the side reflector panels to prevent the side reflector panels from detaching from the center reflector panel;

a circuit board positioned inside the feed assembly and through the opening;

a network connector positioned near a proximal end of the circuit board, wherein the proximal end of the circuit board is located on the convex side of the center reflector panel;

a radiator positioned near a distal end of the circuit board, wherein the radiator is operable to emit radio waves that carry a digital signal received via the network connector, and wherein the distal end of the circuit board is located on the concave side of the center reflector panel; and a sub-reflector located in the feed assembly and near a distal end of the circuit board.

19. The antenna system of claim 18, further comprising a mounting assembly which fastens the multi-panel coupler to a surface external to the antenna system.

20. The antenna system of claim 18, wherein the circuit board includes a radio and is positioned inside a cavity of the feed assembly, wherein the network connector serves as a digital data port for the radio, and wherein the digital data port is accessible from the convex side of the parabolic reflector.

21. A method for assembling an antenna system, the method comprising:

aligning a center reflector panel and two or more side reflector panels to form a parabolic reflector;

fastening a multi-panel fastener to a convex side of the parabolic reflector, wherein the multi-panel fastener preserves the alignment between the center and side reflector panels that forms the parabolic reflector; and coupling a feed assembly to the multi-panel fastener, which involves passing a proximal end of the feed assembly through an opening on the center reflector panel and engaging the multi-panel fastener to secure the multi-panel fastener to a convex side of the parabolic reflector, wherein engaging the proximal end of the feed assembly to the multi-panel fastener secures the side reflector panels to prevent the side reflector panels from detaching from the center reflector panel;

wherein the antenna system further comprises:

a network connector positioned near a proximal end of the circuit board, wherein the proximal end of the circuit board is located on the convex side of the center reflector panel;

a radiator positioned near a distal end of the circuit board, wherein the radiator is operable to emit radio waves that carry a digital signal received via the network connector, and wherein the distal end of the circuit board is located on the concave side of the center reflector panel; and a sub-reflector located in the feed assembly and near a distal end of the circuit board.

22. The method of claim 21, further comprising fastening a first reflector panel of the parabolic reflector to a second reflector panel of the parabolic reflector via an inter-panel fastener, and wherein the inter-panel fastener comprises a first fastener side built into the first reflector panel and a second fastener side built into the second reflector panel.

23. The method of claim 22, wherein the inter-panel fastener includes a post and slot coupling, and wherein fastening the inter-panel fastener involves:

inserting a post coupling of the first reflector panel into a wide portion of a slot coupling of the second reflector panel; and sliding the post coupling along a first axis toward a narrow portion of the slot coupling, which fastens a side surface of the first reflector panel with a side surface of the second reflector panel to prevent movement along a second axis and a third axis orthogonal to the first axis.

24. The method of claim 21, wherein the method further comprises connecting a network cable to the network connector.

25. The method of claim 21, wherein coupling the multi-panel fastener to the parabolic reflector involves inserting at least one wedge-anchor fastener on the multi-panel fastener into a corresponding fastener opening on the parabolic reflector.

26. The method of claim 21, further comprising:

coupling a mounting assembly to the multi-panel fastener, wherein the mounting assembly facilitates fastening the multi-panel fastener to a surface external to the antenna system.

* * * * *